United States Patent [19]

Hackett

[11] 4,360,905

[45] Nov. 23, 1982

[54] INTRUSION ALARM SYSTEM FOR USE WITH TWO-WIRE-CABLE

[75] Inventor: Kenneth R. Hackett, Boulder, Colo.

[73] Assignee: Pittway Corporation, Northbrook, Ill.

[21] Appl. No.: 30,554

[22] Filed: Apr. 16, 1979

[51] Int. Cl.[3] ..... G08B 13/16

[52] U.S. Cl. ..... 367/94; 340/554; 343/5 PD

[58] Field of Search ..... 367/94; 340/554, 538, 340/533; 393/5 PD

[56] References Cited

U.S. PATENT DOCUMENTS

| | | | |
|---|---|---|---|
| 3,680,074 | 7/1972 | Lieser | 340/554 |
| 3,736,584 | 5/1973 | Hackett et al. | 367/94 |
| 3,845,461 | 10/1974 | Foreman | 367/94 |
| 3,942,178 | 3/1976 | Hackett | 367/94 |
| 3,986,182 | 10/1976 | Hackett | 367/94 |
| 4,035,798 | 7/1977 | Hackett | 367/94 |
| 4,123,748 | 10/1978 | Otani | 343/5 PD |
| 4,206,449 | 6/1980 | Galvin et al. | 367/93 |

*Primary Examiner*—Glen R. Swann, III

*Attorney, Agent, or Firm*—Charles E. Pfund

[57] ABSTRACT

An ultrasonic intrusion alarm system has a central control unit and a plurality of remote processors connected to the control unit by means of a single cable having two conductors which need not be shielded. All signals necessary for the proper operation of the system flow along the cable. The control unit provides a modulated ultrasonic signal and DC power to the remote processors along the cable, and each remote processor sends back an alarm along the cable when an intrusion is detected. The signal from each receiving transducer is applied to circuitry in an associated remote processor which detects the presence of doppler shifted signals representative of a moving object in the protected premises. The control unit includes processing circuitry for detecting signals on the cable which indicate that a remote processor has detected a moving object. The control unit further includes circuitry for applying the modulated signal to the cable in a manner which enhances the reliability and performance of the intrusion alarm system, including a novel switching modulator which is very efficient and wastes little energy.

38 Claims, 18 Drawing Figures

INTRUSION ALARM SYSTEM FOR USE WITH TWO-WIRE-CABLE

FIELD OF THE INVENTION

This invention is related to intrusion alarm systems and in particular to intrusion alarm systems having a plurality of transceivers and/or separate transmitting and receiving transducers employed in different areas.

BACKGROUND OF THE INVENTION

Intrusion alarm systems of many different types are known for providing protection of an area against unauthorized entrance. Many prior art systems have the capability to monitor several different protected areas simultaneously to provide an alarm if an intrusion is detected in any of the areas.

Intrusion alarm systems typically detect the presence of an intruder by transmitting an electromagnetic or an accoustic signal into an area and receiving echoes of the transmitted signal. These echoes are then processed to detect the presence of doppler shifted frequency components which indicate the presence of a moving object in the protected area. Such processing generally includes circuitry for discriminating against common false alarm conditions which produce echoes similar to those produced by a moving intruder, which may include ultrasonic signals falling in the doppler signal frequency range, doppler shifted signals produced by air currents in the protected area, or objects such as blinds, moving rapidly back and forth. Examples of prior art processors are shown in U.S. Pat. Nos. 3,942,178, 4,035,798 and U.S. patent application Ser. No. 947,039 filed Sept. 29, 1978 and assigned to the same assignee as the present application. Due to the complexity of the circuitry necessary to perform such processing, most intrusion detection systems which provide protection of several different areas have only one signal processor, and the signals representative of the echoes received by each of the remote receivers are combined and transmitted along a common cable to the signal processor. While this approach results in an economical system, the processor is unable to determine which receiver has detected an intruder. One example of such a system is shown in U.S. Pat. No. 3,736,584.

In an attempt to solve this problem, intrusion detection systems have been developed which include signal processing circuitry at the receivers to provide an indication of which processor has detected an intrusion. Such systems are exemplified by U.S. Pat. Nos. 3,986,182 and 3,680,074. However, known prior art systems of this type have the disadvantage of requiring complex circuitry and/or requiring large numbers of conductors to be routed around the protected premises.

SUMMARY OF THE INVENTION

The present invention includes an ultrasonic intrusion alarm system having a central control unit and a plurality of remote processors which detect and provide an indication of a moving object in the protected premises. The remote processors are typically transceivers including both transmitting and receiving transducers, although individual transmitting and receiving units may be employed. The remote processors are connected to the control unit by means of a single cable having two conductors which need not be shielded. All signals necessary for the proper operation of the system flow along this cable. The control unit provides both a modulated ultrasonic signal and DC power to the remote processors along the cable, and each remote processor sends back an alarm along the cable when an intrusion is detected.

The signal from each receiving transducer is applied to circuitry in each remote processor which detects the presence of doppler shifted signals representative of a moving object in the protected premises. This circuitry is simple enough to allow an intrusion alarm system to have such circuitry in each processor without making the system unduly complex or expensive. Such circuitry further allows a person responding to an alarm signal to determine in which locations an intruder was detected.

The control unit includes processing circuitry for detecting signals on the cable which indicate that a remote processor has detected a moving object. The control unit further includes circuitry for applying the modulated signal to the cable in a manner which enhances the reliability and performance of the intrusion alarm system. This circuitry includes a switching modulator which is very efficient and wastes little energy. A remote control connected to the control unit by means of a second two-conductor cable allows a person to select three modes of operation for the system. Further circuitry is provided to allow the system to be easily tested by an operator.

DESCRIPTION OF THE DRAWINGS

These and other advantages of the present invention will become more clear upon reading the following description of the preferred embodiment in conjunction with the accompanying drawings of which.

DESCRIPTION OF THE PREFERRED EMBODIMENT

Figure 1:
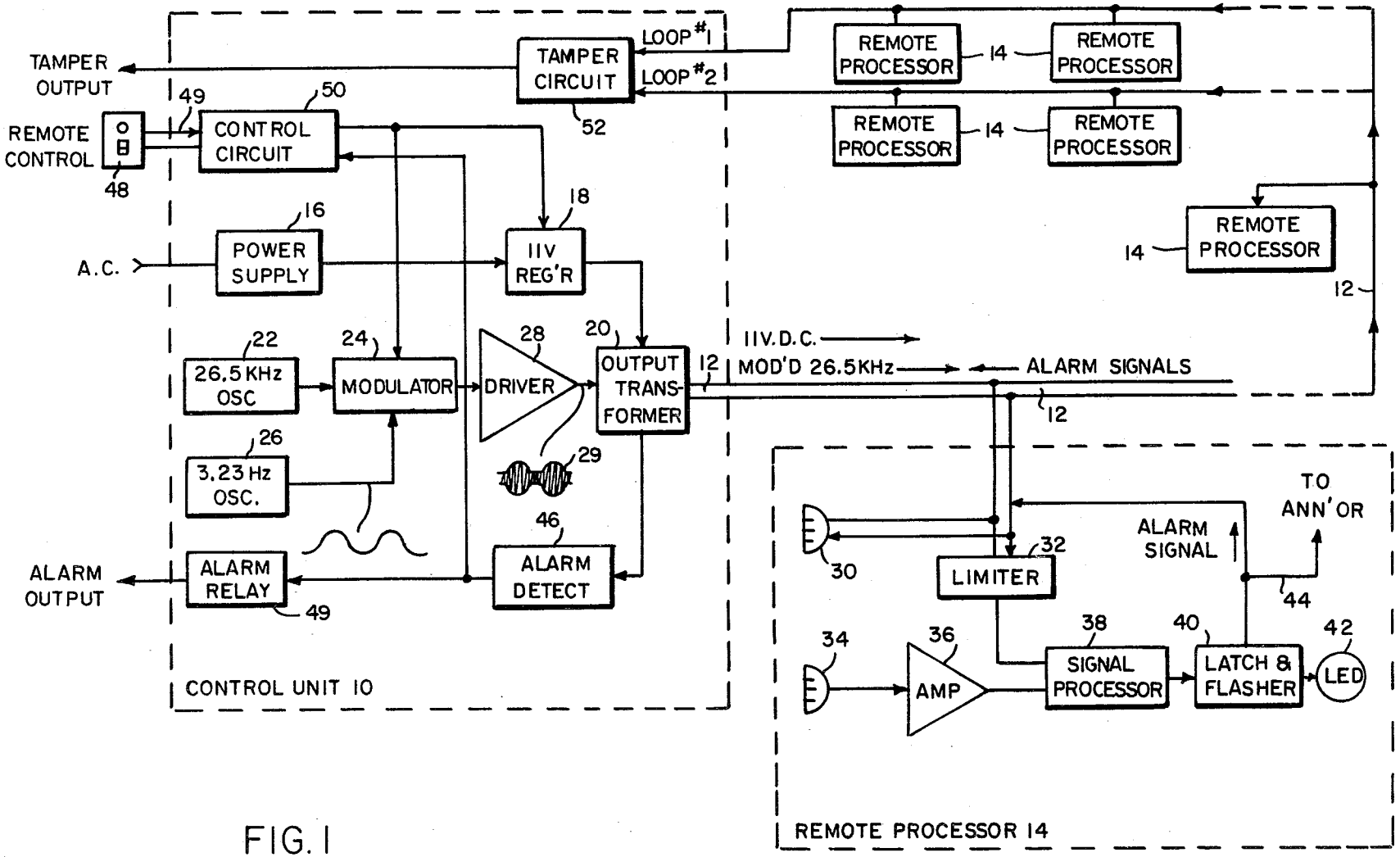
FIG. 1 is a block diagram of the intrusion alarm system.

Referring to FIG. 1, there is shown a simplified block diagram of one embodiment of the present invention. In FIG. 1, a control unit 10 provides signals which are sent out along a cable 12 to a plurality of remote processors 14 which are connected in parallel with the cable 12. Cable 12 may be a two-conductor unshielded cable; and all the signals between the control unit 10 and the remote processors 14 necessary for the proper operation of the intrusion detection system flow along cable 12. These signals include DC power from control unit 10 which supplies the power for the electronics in each remote processor 14, a modulated ultra-sonic signal from control unit 10 used for exciting the transmitting transducers in the remote processors 14 and for recovering the ultra-sonic signals received by the receiving transducers, and alarm signals from remote processor 14 sent back to control unit 10 which indicate when a remote processor has detected the presence of a moving intruder.

Control unit 10 includes several different circuits, as indicated in FIG. 1. Each of these circuits is discussed in more detail below. A power supply 16 provides the low voltage DC power which drives the circuitry of the intrusion alarm system. The power supply normally operates off of the AC power lines. Power supply 16 also includes a rechargeable battery which provides power to the system in the event of a power outage. The output voltage from power supply 16 is approximately 14.2 volts DC in the present example and this power is applied to the various different circuits contained within control unit 10. The output from power supply 16 is also applied to a second voltage regulator 18. Regulator 18 provides a regulated 11 volt output voltage. This voltage is applied to an output transformer circuit 20 which couples the output voltage from regulator 18 to the cable 12.

An oscillator 22 produces a 26.5 kHz signal at its output which is the source of the ultra-sonic signals necessary for driving the transmitting transducers and for demodulating the signals received by the receiving transducers. The ultrasonic output signal from oscillator 22 is applied to one input of a modulator 24. A second input to modulator 24 receives a low frequency signal from an oscillator 26 used to modulate the ultrasonic signal applied to the remote processors. In the described embodiment, the frequency of the output signal from oscillator 26 is 3.23 Hz.

The output from modulator 24 is a 26.5 kHz ultrasonic signal modulated with a 3.23 Hz envelope. This signal is amplified by a driver amplifier 28 and applied via output transformer 20 to the cable 12. The modulation of the 26.5 kHz signal never drops to zero. This is necessary because the remote processors 14 derive a 26.5 kHz reference signal, for demodulating the doppler shifted echoes, by limiting the 26.5 kHz signal applied to cable, as is shown in waveform 29 in FIG. 1.

Each of the remote processors 14 is connected in parallel to cable 12. The modulated ultrasonic signal is applied to a transmitting transducer 30 which radiates ultrasonic signals into the area to be protected. The signal on cable 12 is also applied to a limiter circuit 32 which provides an unmodulated 26.5 kHz signal at its output.

Ultra-sonic signals reflected back from objects in the protected area are received by a receiving transducer 34 and converted into electrical signals. these electrical signals are amplified by a variable gain amplifier 36 and applied to signal processing circuitry 38. The unmodulated 26.5 kHz output from limiter 32 is also applied to signal processor 38 and used to demodulate the signals from receiving transducer 34. The output from signal processor 38 is indicative of whether a moving intruder has been detected within the protected area. Although the presently described embodiment includes transmitting and receiving circuits combined in a single transceiver, individual receiving and/or transmitting units may be used, if desired.

The output from signal processor 38 is applied to a latch and flasher circuit 40. In response to a signal from processor 38, a latch is set in circuit 40 which indicates that the remote processor has detected an intruder. This latch remains set until it is reset in response to a clear command from control unit 10, as described below. A light emitting diode (LED) 42 is driven by an output from latch and flasher circuit 40. In response to a signal from processor 38 indicating that a moving intruder is being detected, latch and flasher circuit 40 causes LED 42 to remain on continuously as long as motion is detected in protected area. If motion ceases in the protected area, the output signal from processor 38 no longer indicates the presence of an intruder; and in this case the latch and flasher circuit 40 which has been previously set by the detection of an intruder causes LED 42 to flash until the latch is reset from the control unit 10. Thus, after an intruder has been detected by a particular remote processor 14, the associated latch circuit 40 is set to allow a person responding to an alarm system to determine in which area or areas intrusion was detected. This may be determined by walking through the protected premises and observing the flashing LED 42, or an optional wire 44 may be run from each of the remote processors 14 to an annunciator panel.

An alarm detection circuit 46 is coupled to cable 12 via transformer circuit 20. Alarm detection circuit 46 monitors the power drawn by the several remote processors 14 which are connected to cable 12. If and when a remote processor detects the presence of an intruder, the associated LED 42 is illuminated by the processor circuitry. Alarm detection system 46 monitors the power drawn by the remote processors attached to the cable 12, and when an LED is illuminated by a processor in response to the detection of an intrusion, the sudden increase in current drawn by the remote processors is detected by alarm detection circuitry 46 which provides an alarm output to signal that an intrusion has been detected.

The intrusion detection system operates in one of three modes: clear mode, store mode or hold mode. The mode is selected by means of a remote control 48 and associated control circuitry 50 located in control circuit 10. The remote control circuit 48 is connected to control circuitry 50 by means of a two-wire cable 49–50 and may be located at an entrance to the premises or at some other location convenient for its operation. During store mode, the intrusion detection system operates as described above, and the detection of an intruder by any of the remote processors 14 causes that processor to set the associated latch 40 indicating that an intruder has been detected. If hold mode is selected by remote control 48, control circuitry 50 disables the 26.5 KHz input to ultrasonic driver 28 so that the transmitting transducer driving signal is removed from cable 12. As a result, once hold mode is selected, the latches in each of the remote processors 14 all remain in the state in which they were when hold mode was selected. Hold mode may be used, for example, by a person responding to an alarm who wishes to walk through the premises to determine which remote processors have detected an intruder, as indicated by a flashing LED on a processor which has detected an intruder. By selecting hold mode, the person responding avoids triggering each of the remote processors as he or she walks through the premises.

To reset each of the remote processors 14, the remote control 48 is momentarily switched to clear mode. In response, control circuitry 50 causes the 11 volt regulator 18 supplying power to each of the remote processors 14 to periodically interrupt the DC power applied to cable 12. Circuitry within each of the remote processors 14 detects this periodic interruption of power and resets the latch 40 in the remote processor in response to such an interruption.

Control unit 10 also includes tamper circuitry 52 which may be connected in a conventional tamper loop to provide an indication if the intrusion detection wiring has been interrupted. The presently-described embodiment has provisions for monitoring two, independent tamper loops.

Figure 2:
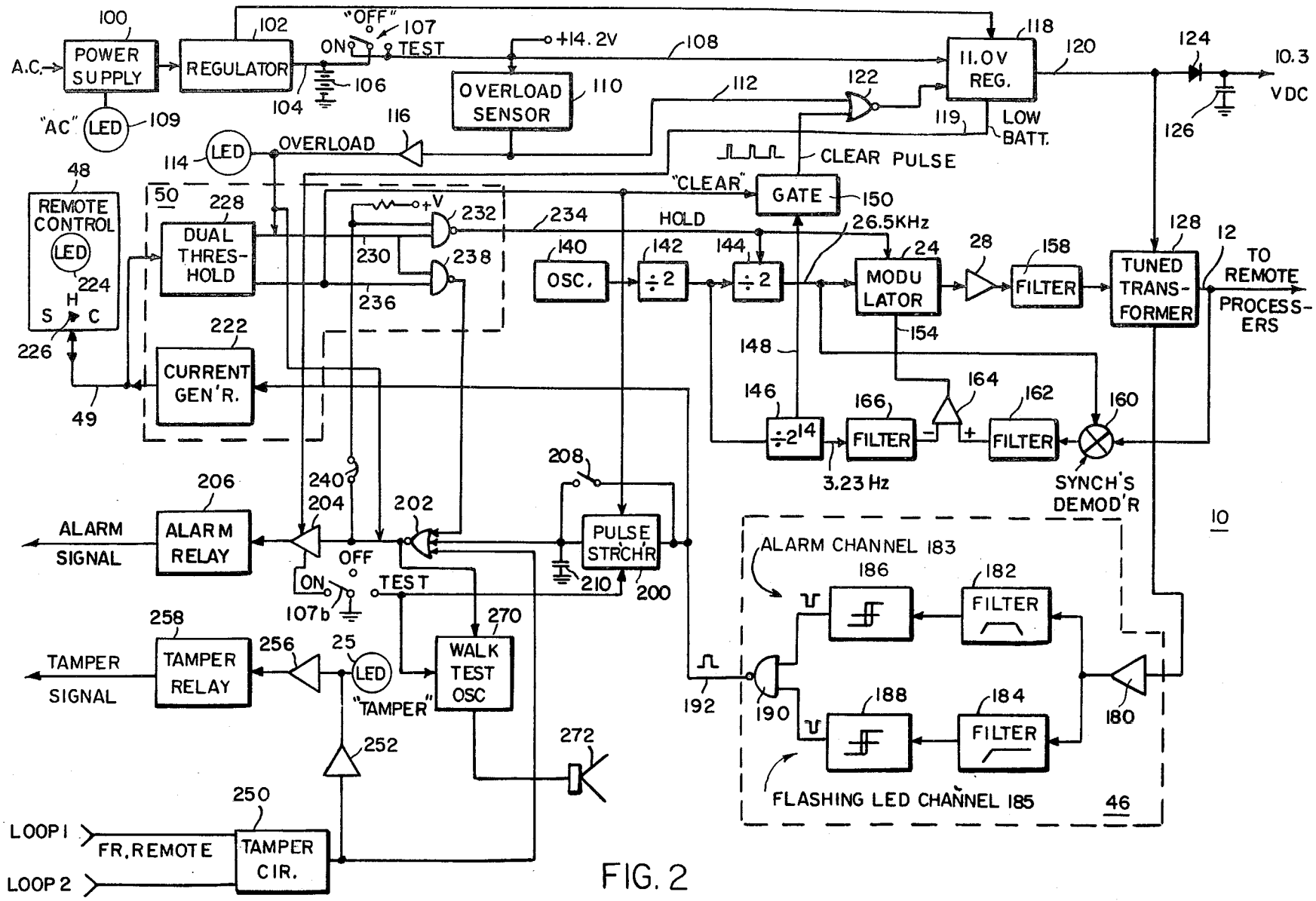
FIG. 2 is a block diagram showing more details of the alarm system control unit.

Referring to FIG. 2, there is shown a detailed block diagram of control unit 10. Low voltage AC power, typically produced by a stepdown transformer, is applied to a rectifier and filter circuit 100 which applies an unregulated DC voltage to a voltage regulator 102. In the embodiment described herein, regulator 102 provides 14.2 volts at its output terminal 104. Connected to the output terminal of the regulator 102 is a battery 106 which provides power to the intrusion alarm system in the event of a power failure on the AC lines. The output voltage from regulator 102 is chosen to provide the proper voltage to maintain battery 106 in a charged state. An LED 109 is connected to rectifier and filter circuit 100 and is illuminated when AC power is present on the power lines.

The voltage on terminal 104 is applied to a switch 107 which applies power to the remainder of the system when switch 107 is in either the "on" or "test" positions. D.C. power is always applied to battery 106, however, to keep it in a fully charged condition, even when the alarm system is turned off. When power is applied to the system, 14.2 volts are present on line 108, and this voltage is applied to power certain portions of the control unit circuitry. The voltage on line 108 is also applied to an overload sensor 110. Overload sensor 110 monitors the voltage on line 108, and when this voltage drops below a predetermined value, the overload sensor provides an overload signal on line 112. The overload signal drives an overload LED 114 via LED driver 116. If an overload condition is detected, an 11 volt regulator 118 which supplies power to the alarm system is shut down. The system logic is no longer powered and the alarm relay 206 drops in providing an alarm signal. The overload signal is also applied to control circuit 50 to immediately turn off the ultrasonic drive power to the remote processor 14 and to the alarm circuitry to indicate an alarm condition.

The 14.2 volt power on line 108 and a reference voltage from the regulator 102 are applied to a second voltage regulator 118 which provides a regulated 11.0 volt signal at its output terminal 120. A NOR gate 122 has its output connected to a disable input to the 11-volt regulator 118. In response to a low logic level on this input, the 11 volt regulator 118 is disabled and the voltage at its output terminal goes to 0. One input to NOR gate 122 is the overload signal from overload sensor 110, and if an overload condition is sensed, regulator 118 is disabled to prevent damage to the alarm system circuitry. A second input to NOR gate 122 is used to disable regulator 118 in order to provide a clear signal to the remote processors 14. This is described in more detail below. If the alarm system is operating on battery power, the voltage on line 108 drops when the battery approaches a discharged condition. This low voltage on line 108 is detected by regulator 118 which applies a "low battery" signal on line 119 to alarm driver circuit 204, disabling driver circuit 204 and producing an alarm signal.

The 11 volt DC power on line 120 is applied to a tuned output transformer 128 which transmits this power to the remote processors along the cable 12. The output voltage from regulator 118 is also applied to the low power logic circuitry in the control unit via an isolation circuit composed of a diode 124 and capacitor 126. As described below, the remote processors 14 are reset from an alarm to non-alarm condition by momentarily reducing the power voltage applied to cable 12 to zero. The diode 124 and capacitor 125 provide conuous power to the control unit logic circuitry when the remote processors are being cleared.

A 106 kHz oscillator 140 provides the time base from which the ultrasonic carrier frequency and lower frequency modulation signals are derived. Two flip-flops, 142 and 144, divide the output signal from oscillator 140 by 4 to provide a 26.5 kHz signal which is applied to the modulator circuit 24. The output signal from flip flop 142 is applied to a 14 bit counter 146 which divides the output frequency of flip-flop 142 by $2^{14}$ to provide a modulation signal of approximately 3.23 Hz at its output. A signal derived from the last several output stages of counter 146 provides a second output from counter 146 on line 148 which is composed of pulses approximately 10 ms wide occuring at a 6.46 Hz rate. This signal is applied to a gate circuit 150. A second input to gate circuit 150 is the clear signal from control circuitry 50, and in response to a clear signal applied to gate 150, the 6.46 Hz pulses are transmitted to NOR gate 122 to disable regulator 118. In this manner, the clear signal is transmitted to the remote processors 14.

Returning to modulator 24, the 26.5 kHz signal from flip-flop 144 is applied to a modulator 152. A second signal, derived as described below is used to modulate the ultrasonic carrier at a 3.23 Hz rate. The output from modulator 24 is applied via driver circuit 28 and a 26.5 kHz bandpass filter 158 to the tuned output transformer 128 which sends the ultrasonic signal to the remote processor via cable 12. The signal applied to cable 12 is fed back to a synchronous detector 160.

The 26.5 kHz waveform from flip-flop 144 is also applied to a second input of synchronous demodulator 160. The synchronous demodulator demodulates the signal applied to cable 12 to reproduce the low-frequency modulation waveform. The output from demodulator 160 is low-pass filtered by filter 162 to attenuate high-frequency demodulation components and is applied to one input of a differential amplifier 164.

The 3.23 Hz output from counter 146 is processed by a pulse shaper and filter circuit 155 to provide an output signal which is representative of the desired modulation envelope. This signal is applied to a second input of differential amplifier 164. The differential amplifier compares the desired modulation envelope applied to one input with the actual modulation envelope from demodulator 160 applied to other second input and produces an output signal representative of the difference between the two signals. The output from differential amplifier 164 is applied to modulator 24 to modulate the 26.5 kHz ultrasonic signal which is provided to the remote processors.

The modulation signal on line 154 is the result of negative feedback and a comparison of the actual modulation envelope with the desired modulation envelope; and this circuit provides a very accurate modulation of the ultrasonic signal. Precise control of the modulation envelope is important in preventing discontinuities from appearing in the modulated ultrasonic signal applied to the transducers. Such discontinuities, if present, would occur at the modulation frequency and could contain harmonics which extend up into the same frequency band as the doppler-shifted echoes representative of an intruder. Since the harmonics of the modulation signal have the correct modulation frequency, such discontinuities could result in false alarms.

An alarm signal is detected by control unit 10 in the following manner. In response to motion detected by a remote processor, the associated LED is illuminated for as long as the motion is detected. After the motion has ceased, the remote processor LED continues to flash, until the control unit is momentarily switched to clear mode, to provide an indication of which processors have detected motion.

When the LED in a remote processor is illuminated, the current drawn by that processor suddenly increases by the current required to illuminate the LED. In the presently-described embodiment, this results in a step increase in the DC current flowing through cable 12 of approximately 5 mA. The total current drawn by the remote signal processors is sensed by an amplifier 180 in alarm detection circuitry 46.

The output from amplifier 180 is applied to two different signal processing channels. The first channel is an alarm channel 183 which detects signals on cable 12 indicating that a remote processor is currently detecting motion. The second channel is a flashing LED channel 185 which detects when the LED in a remote processor is flashing to indicate that motion has previously been detected by that processor. Each channel includes a filter which extracts the desired information from the output signal of amplifier 180 and a following Schmitt trigger which provides an output when the output signal from the associated filter exceeds the Schmitt trigger threshold.

The output from amplifier 180 is applied to a bandpass filter 182 in alarm channel 183. Bandpass filter 182 has a very low center frequency and is only responsive to changes in the signal from amplifier 180 which persists for more than approximately 1.4 seconds. Thus, bandpass filter 182 is not sensitive to the short duration pulses produced by a flashing LED in a remote processor. If the LED in a remote processor remains on for a long period of time due to continuous motion, the output from bandpass filter 182 will eventually drop to zero. This is because bandpass filter 182 is AC coupled and is looking for a change in the load current flowing through cable 12. After a period of time, a steady signal from a remote processor no longer appears as an increase and the output from filter 182 drops. However, an alarm indication is still provided in response to the short duration signals produced by a flashing LED in the processor which has alarmed, as described below.

The output from amplifier 180 is applied to a high pass filter 184 in the flashing LED channel 185. The frequency response of filter 184 is chosen so that it passes current pulses produced by a flashing LED in a remote processor. Since the leading edge of a current step indicating the detection of an intruder includes higher harmonics, highpass filter 184 is also responsive to the leading edge of a signal denoting detected motion, but due to the short time constant of filter 184, the response of filter 184 to such signals drops rapidly to zero.

The outputs from filters 182 and 184 are respectively applied to Schmitt trigger circuits 186 and 188. The Schmitt trigger circuits respond to signals passed by each of the filters which exceed the input threshold of the Schmitt trigger. The outputs from the Schmitt trigger circuit 186 and 188 are normally high and go low in response to a pulse from the associated filter. The outputs from the Schmitt triggers are applied to a NAND gate 190 which provides a high level at its output 92 in response to a low signal from either or both Schmitt triggers.

Thus, in response to motion detected by a remote processor 14, the output on line 192 from alarm detection circuitry 46 goes high, indicating that motion is being detected. After motion is no longer being detected, the output on line 192 is a series of short duration pulses (10 milliseconds in the presently described embodiment) which are produced by the flashing LED in the remote processor.

The output from alarm detection circuitry 46 is applied to a pulse stretcher circuit 200. Pulse stretcher circuit 200 is responsive to the short duration pulses produced by flashing LEDS in processors which have previously detected motion; and in response to such pulses, pulse stretcher 200 provides a continuously high signal at its output. This signal is applied via a NOR gate 202 to a relay driver 204 which drives the alarm relay 206. Thus, when a remote processor detects motion, the alarm relay is activated. If the intruder leaves the area and motion is no longer detected by a processor, the pulses from the remote processors are stretched by pulse stretcher 200 and continue to maintain alarm relay 206 in an activated condition.

If desired, pulse stretcher 200 may be bypassed by means of a switch or jumper wire 208. When switch 208 is closed, pulse stretcher 200 is deactivated. In this case, after an intrusion has been detected, and the LED in a remote processor is flashing, the short duration pulses on line 192 are no longer stretched by pulse stretcher 200. A capacitor 210 connected to the input of NOR gate 202 filters out the short duration pulses produced by the flashing LEDS and causes the alarm relay to be de-activated when motion is no longer detected by the remote processors.

Control circuit 50 is connected to a remote control via a two-wire cable 49. Located at the remote control unit is a switch 226 which selects the alarm system mode and an indicator such as a LED, which indicates the present alarm or non-alarm status of the intrusion alarm system.

The output from alarm detection circuitry 46 is applied to a current generator 222 within control circuit 50. The current applied to the remote control unit is determined by control generator 222. In response to an alarm signal from NAND gate 190, current generator 222 applies a high-level current to the remote control, lighting the LED. The input to current generator 222 is taken before pulse stretcher 200, and after motion is no longer being detected by the remote processors 14, the short pulses produced at the output of alarm detection circuit 46 cause current generator 222 to apply current pulses to the remote control unit. These pulses cause the indicator light to flash periodically providing an indication of the current status of the alarm system.

Switch 226 on the remote control unit selects clear, hold, or store modes for the intrusion alarm system. In response to the selection of a particular mode, the remote control unit 48 applies a corresponding voltage of a pre-determined value to cable 49. A dual threshold detector circuit 228 in control circuitry 50 senses the voltage present across the conductors of cable 49, and thus senses the selected state of the intrusion alarm system. When the alarm system is in store mode, threshold detector 228 provides no output signals. In response to hold mode being selected, a hold output line 230 is activated. Line 230 is applied via a NAND gate 232 to line 234. The signal on line 234 is applied to flip-flop 144 and also to modulator 24; and in response to a hold signal, flip-flop 144 and modulator 24 are disabled, removing the ultrasonic signal from cable 12. Thus, after hold mode has been selected, the remote processors are no longer excited with an ultrasonic signal and will remain in their present alarm or non-alarm state. This allows a person responding to an alarm signal to put the instrusion alarm system into hold mode and then walk through the premises to determine where intrusion has occurred without causing the remote processors 14 to be triggered into the alarm state by that person's motion.

In response to the selection of clear mode by switch 226, threshold detector 228 activates a clear output line 236. The signal on line 236 is applied to gate circuit 150 described above. In response to a clear signal, circuit 150 applies clear pulses via NOR gate 122 to regulator 118; and the remote processors are reset to the non-alarm state by the resulting clear pulses transmitted over cable 12. The clear signal is also applied to pulse stretcher circuit 200. In response to a clear signal, capacitor 210 is immediately discharged to prevent the alarm relay from being reactivated by the voltage stored on capacitor 210.

A NAND gate 238 has applied thereto both the hold and the clear signals from threshold detector 228. In response to either hold or clear mode being selected, the output from NAND gate 238 goes high and is applied via NOR gate 202 and relay driver 204 to activate alarm relay 206. This is done to prevent the system from being left in hold or clear mode. Thus, upon leaving the premises, a person who has left the alarm system in hold or clear mode, will note that the system is in an alarm state, as indicated by the alarm relay and/or the indicator 224 on the remote control.

The output signal from NOR gate 202 is applied via a switch 240 or a jumper wire to a second input of NAND gate 232. When switch 240 is closed, the alarm system will automatically go into hold mode in response to the first alarm signal from a remote processor indicating the presence of an intruder, and if pulse stretcher 200 is not disabled by switch 208, the system will remain in hold mode until it is cleared. This allows a person responding to an alarm signal to determine where the intrusion was first detected.

Two tamper loops may be connected to the remote processors 14 to provide an indication of whether the interconnecting cabling has been tampered with. These two loops are connected to tamper circuitry 250 and in response to a signal on either loop indicating that the alarm system wiring has been interrupted, tamper circuitry 250 provides a signal at its output. The output signal from tamper circuitry 250 is applied to an LED driver circuit 252. The output from driver circuit 252 illuminates a tamper LED 25 and is also applied via a relay driver circuit 256 to a tamper relay 258 which provides a tamper output indication. The tamper signal is also applied to NOR gate 202, and the alarm system also provides an alarm signal in response to a tamper output from tamper circuit 250.

The output from NOR gate 202 is also applied to one input of a walk test oscillator 270. A second section **107*b* of switch 107 is connected to an enable input of walk test oscillator 270; and when the test position is selected by switch 107, walk-test oscillator 270 is enabled. Switch 107*b* is also connected to pulse stretcher circuit 200 and disables the pulse stretcher circuit during test mode to provide a fast reset in response to alarm signals. When in test mode, switch 107*b* also disables relay driver 204, and this maintains the output of relay driver 204** in an alarm condition to prevent the system from inadvertently being left in test mode.

When walk test oscillator 270 is enabled, it is responsive to the output from NOR gate 202 and provides an audible signal via a walk test horn 272 in response to an alarm signal. Normally, since each remote processor is independent, the sensivitity of each processor can be set by monitoring its LED 42. The LED 42 gives an indication that the remote processor under test is responding properly, but does not confirm that the alarm signal has been properly transmitted to and received by the control unit 10. When switch 107 is in test mode, an audible signal is produced by horn 272 each time a remote processor detects motion. Thus, a person may easily verify that the system is operating properly by walking through the premises. The LED 42 in each remote processor confirms that the processor has detected motion, and the audible horn signal verifies that the control unit has properly responded to the detection of motion by the processor.

Figure 3:
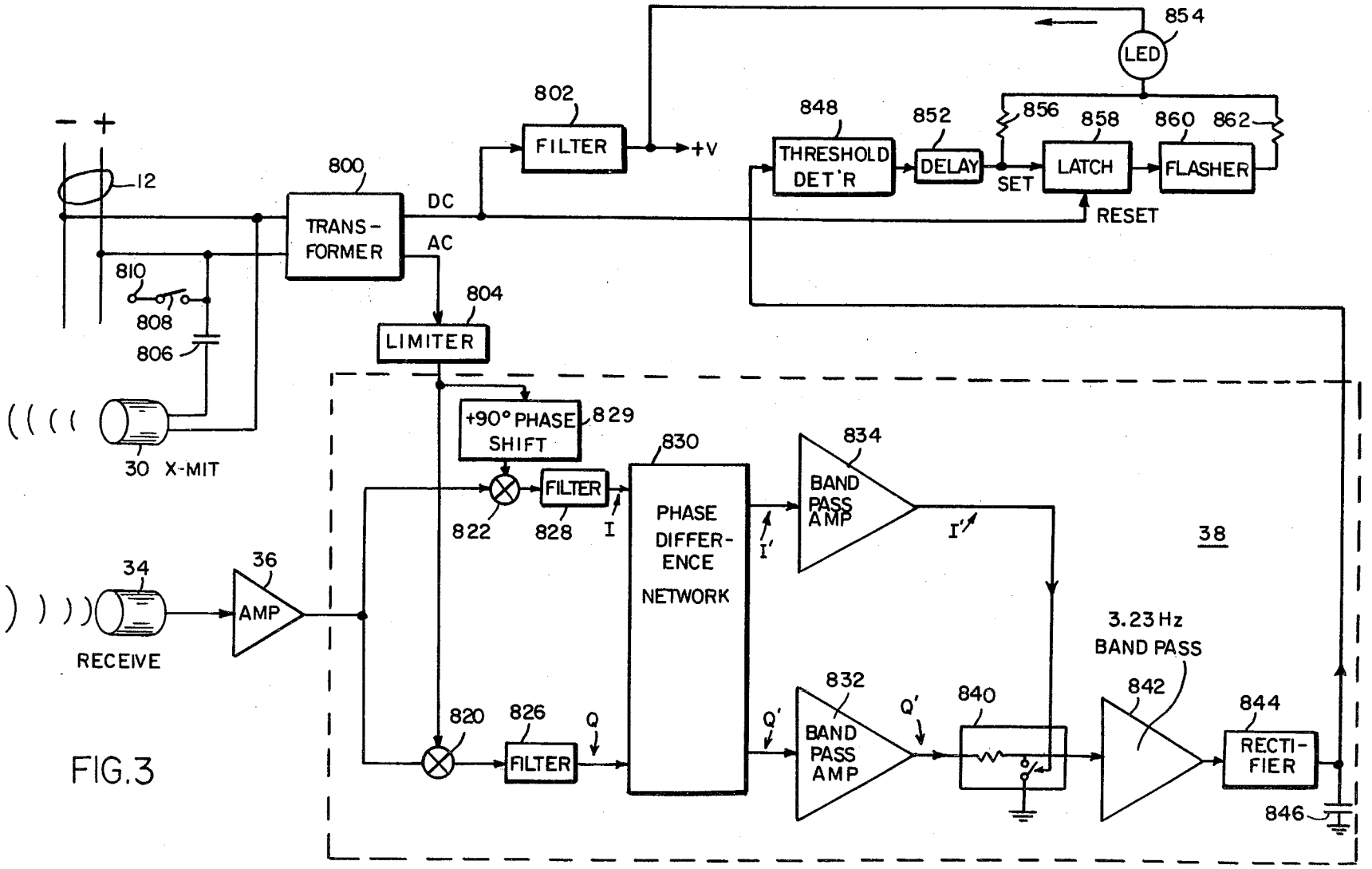
FIG. 3 is a block diagram showing more details of the remote processors of the alarm system.

Referring to FIG. 3 there is shown a detailed block diagram of one of the remote processors 14. The signals from cable 12 are applied to a signal splitting transformer 800. One output from transformer 800 is a DC signal which has most of the modulated 26.5 kHz signal removed. This signal is applied to a filter circuit 802, which provides further filtering of the DC signal. The output from filter 802 provides the DC voltage to power the remote processor circuitry.

A second output from transformer 800 consists of the modulated ultrasonic signal from which the DC component has been removed, and this signal is applied to a limiter circuit 804. As explained above, the modulation of the ultrasonic carrier is less than 100% and thus a certain amount of 26.5 kHz signal is always present. The 26.5 kHz signal is amplitude-limited by limiter circuit 804, and the output from the limiter circuit is a squared-up 26.5 kHz signal from which the low frequency modulation has been removed. The 26.5 kHz signal from limiter 804 is used to detect the doppler-shifted echoes, as discussed below.

The transmitting transducer 30 is connected directly across the conductors of cable 12. A DC blocking capacitor 806 removes the DC component of the signal on cable 12 and provides transducer 30 with the modulated 26.5 kHz ultrasonic signal. If the continuity of cable 12 is being supervised by a tamper line, the positive supply line may be routed through an optional tamper switch 808 built into the cover of the enclosure for the remote processor 14. In this case, the positive conductor of cable 12 to the next processor is taken from terminal 810 connected to tamper switch 808.

Echoes from the protected area are received by receiving transducer 34 and converted to electrical signals. The signals are amplified by an amplifier 36 and applied to signal processing circuitry 38 which detects doppler-shifted signals in the received echoes which indicate the presence of a moving intruder.

The output from amplifier 36 is applied to two synchronous demodulators 820 and 822. The unmodulated 26.5 kHz signal from limiter 804 is applied to a second input of modulator 820. This signal is shifted by 90° by phase shifting circuit 829 and applied to a second input to demodulator 822. The outputs from demodulators 820 and 822 include the base-band doppler signals and harmonics produced by the demodulation process. The outputs from the demodulators are applied to low pass filters 826 and 828, which remove the 26.5 kHz and higher frequency components to provide the base band doppler-shifted frequencies at their outputs. When no motion is being detected, there are no doppler-shifted echoes, and the outputs from low pass filters 826 and 828 are essentially zero. When a moving intruder is in the protected area, the outputs from filters 826 and 828 are in-phase and quadrature-phase base-band doppler signals. These in-phase and quadrature signals are denoted in FIG. 3 as I and Q respectively. When there is a moving intruder in the protected area, the I and Q components are identical in frequency but 90° apart in phase. The Q component leads or lags the I component by 90° depending on the direction of intruder motion.

The I and Q signals are applied to a constant phase difference network 830. Network 830 introduces an additional 90° phase shift between the I and Q signals. The phase-shifted outputs from network 830 are denoted as Q′ and I′. The Q′ and I′ signals are either in phase or 180° out of phase, depending on the direction of intruder movement.

Figure 14:
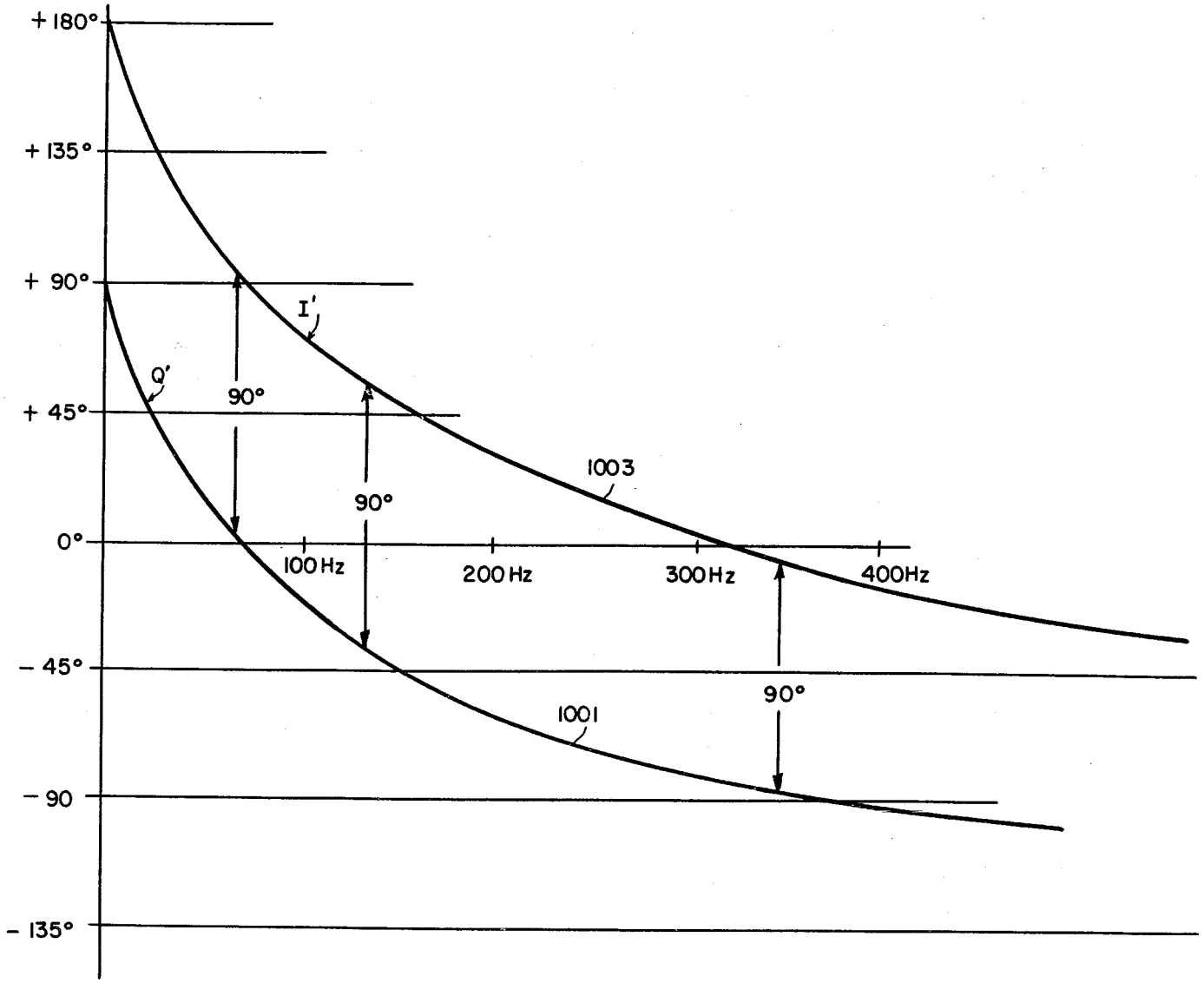

Phase difference network 830 is used to provide a constant phase shift between the two signals over the wide range of frequencies which the doppler-shifted echoes may include. The baseband doppler-shifted echoes may occur in a range from about 30 Hz to about 150 Hz. The phase shifts introduced into the I′ and Q′ signals as a function of the doppler-shifted frequency is shown in FIG. 14. Although the phase shift introduced into the I′ and Q′ signals varies, the difference between the phase shifts is constant and is equal to 90°. A phase difference network is preferred, rather than a phase shifting circuit, because such a network is much simpler than a phase shift circuit which provides a constant 90° phase shift over such a wide frequency range.

The output signals from network 830 are applied to two bandpass amplifiers 832 and 834. These amplifiers remove frequency components outside the range of interest and aid in reducing the number of false alarms. The output signals from the bandpass amplifiers are applied to a switching demodulator 840. Q′ signal from amplifier 832 is applied to the input of demodulator 840, and the I′ signal from amplifier 834 is applied to the control input of demodulator 840.

Any doppler signals which are present in the outputs from amplifiers 832 and 834 are either in phase or 180° out of phase. Thus, the output of switching demodulator 840 is a series of half sine waves and the polarity of these sine waves is either positive or negative, depending on the direction of motion. The amplitude of the output signal from demodulator 840 is a function of the amplitude of the received ultrasonic signal. Since the ultrasonic carrier is modulated at a 3.23 Hz rate, any doppler signals present in the output from the modulator 840 have a 3.23 Hz amplitude modulation component. Other signals occurring in the same frequency range as doppler signals, such as telephone bell harmonics, are not characterized by a 3.23 Hz amplitude variation. This allows the signal processing circuitry to discriminate between true doppler signals and other signals falling in the frequency range of interest which would otherwise cause false alarms. The modulation component in the output signal from demodulator 840 is detected by a narrow-band bandpass amplifier 842 having a center frequency of 3.23 Hz.

Figure 4:
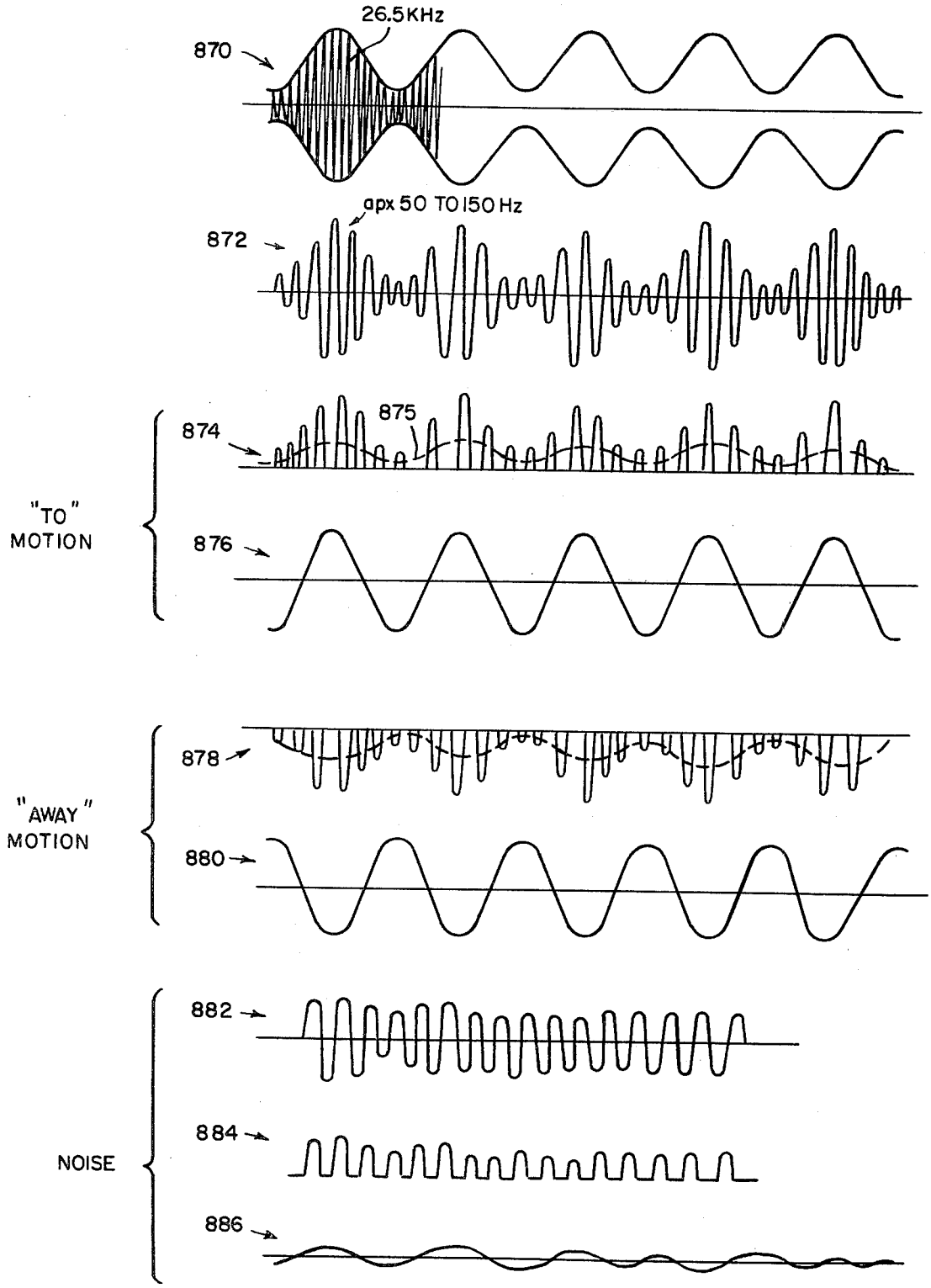
FIG. 4 shows waveforms useful in explaining the operation of the circuitry shown in FIG. 3.

The above-described processor operation can be more easily understood by referring to the waveforms shown in FIG. 4. Waveform 870 represents the ultrasonic signal from transmitting transducer 30. This signal is a 26.5 kHz signal amplitude-modulated at a 3.23 Hz rate. Waveform 872 in FIG. 4 represents the recovered doppler signal after the signal from the receiving transducer 34 has been demodulated and filtered. Waveform 872 represents the I and Q signals present at the output of low pass filters 826 and 828, except that the I and Q signals are 90° out of phase. After passing through phase difference network 830, the I′ and Q′ signals are still as shown in waveform 872, except that these waveforms are now either in-phase or 180° out of phase, depending on the direction of the detected motion.

If the direction of motion is towards the receiving transducer, the I′ and Q′ signals are in-phase, and the output from demodulator 840 is as shown in waveform 874. Waveform 874 is a series of positive half-cycles of the doppler frequency, amplitude-modulated at a 3.23 Hz rate. Dotted waveform 875 represents the 3.23 Hz component in waveform 874. When signal 874 is applied to bandpass amplifier 842, the output is a 3.23 Hz signal as shown by waveform 876.

If the detected motion is in a direction *away* from the receiving transducer, the above-described operation is repeated, except that the I′ and Q′ signals are 180° out of phase, rather than in-phase as before. Thus, the output from demodulator 840 consists of a series of *negative* half cycles of the doppler frequency, in contrast to the case for motion toward the transducer which produced positive half cycles. Again, the negative half cycles are amplitude modulated at a 3.23 Hz frequency, as shown by the dotted line in waveform 878. In response to waveform 878, the output from bandpass amplifier 842 is a 3.23 Hz signal as shown by waveform 880.

It should be noted that the outputs from bandpass amplifier 842 in response to "to" and "away" motion are 3.23 Hz signals in both cases, but the phases of the signals are 180° out of phase. This distinction allows the processing circuitry shown in FIG. 3 to distinguish an intruder from rapid back and forth motions, such as fans or fluttering curtains, which would otherwise cause false alarms. Such rapid back and forth movement results in a signal from demodulator 840 which has a frequency of 3.23 Hz but which rapidly alternates between two phases which are 180° apart. If the response time of bandpass amplifier 842 is longer than the interval between phase intervals, the bandpass amplifier will not respond to such signals, which otherwise would cause false alarms.

Waveforms 882 through 886 in FIG. 4 show the response of the processor circuitry to a spurious signal falling in the ultrasonic doppler frequency range. Waveform 882 illustrates the I′ and Q′ components resulting from such an interfering signal. The output from demodulator 840 is a series of sine wave half-cycles, as shown in waveform 884 of either positive or negative polarity, depending on whether the interfering signal has a frequency above or below 26.5 kHz. However, the output from demodulator 840 does not contain a 3.23 Hz modulation component, in contrast with received signals which are Doppler-shifted echoes resulting from detected motion. Thus, in response to waveform 884 applied to its input, the output from bandpass amplifier 842 remains at zero or a very low level as shown by waveform 886. This signal does not trigger the following circuitry and no alarm is indicated by the processor.

The output from bandpass amplifier 842 is applied to a rectifier circuit 844 which provides a signal at its output representative of the amplitude of the 3.23 Hz component detected by bandpass amplifier 842. The output from rectifier 844 is filtered by a capacitor 846 and applied to a threshold detector 848. When the amplitude of the signal from rectifier 844 exceeds a predetermined level, the output of threshold detector 848 goes high indicating an alarm condition. A delay circuit 852 is connected to the output from threshold detector 848 and in response to an alarm signal, the output of delay circuit 852 is activated for a minimum of two seconds. This insures that the alarm signal transmitted back along cable 12 to control unit 10 is long enough to trigger the alarm channel circuitry 183 and to cause the control unit to indicate an alarm condition even if pulse stretcher 200 is deactivated.

The output from delay circuit 852 is applied to an LED 854 via a resistor 856. The second terminal of LED 854 is connected to the DC output from filter 802. The current drawn by LED 854 is the quantity detected by the alarm circuitry 46 in control unit 10 and causes the control unit to indicate an alarm.

The output from delay circuit 852 is also applied to one input of a latch circuit 858, and in response to the detection of an alarm signal by threshold detector 848, latch circuit 858 is set. The output of latch circuit 858 is applied to a flasher circuit 860. The output of flasher circuit 860 consists of a series of narrow pulses which repeat at a low frequency. In the presently described embodiment, the pulses are approximately 10 to 20 milliseconds long and have a frequency of approximately 1 Hz. LED 854 is illuminated by the output from delay circuit 852 as long as a Doppler signal indicating motion is detected by the processing circuitry. After motion has ceased being detected, the output from delay circuit 852 is deactivated and LED 854 is no longer illuminated by the output from the delay circuit. However, latch 858 is set by the output from the delay circuit and causes flasher circuit 860 to continue to flash LED 854 at a low frequency. This provides an indication that a particular remote processor 14 had previously detected motion.

As described above, when an operator selects clear mode and the latches in each of the remote processors are to be reset to their non-alarm state, a series of short pulses are applied to the power supply 11810 milliseconds wide and occur at rate of twice the modulation frequency, of 6.47 Hz. The unfiltered DC voltage from transformer 800 is applied to the reset input of latch 858. In response to a low signal at the reset input, latch 858 is reset to its non-alarm state. Thus, the clear pulses on cable 12 reset any remote processors which may have alarmed. The duration of the clear pulses is short enough so that the output from the power supply filters 802 in the remote processors is uninterrupted. Thus, DC power continues to be applied to the processing electronics in the remote processors during the clear mode. The output from power supply filter 802 may contain a small ripple component at the clear signal frequency during clear mode. By selecting the clear frequency to be twice the ultrasonic modulation frequency, any perterbations in the processing electronics 38 which may result from such ripple in the power supply voltage will be at a frequency which does not interfere with the processing electronics and which does not produce an output signal from bandpass amplifier 842.

Figure 5:
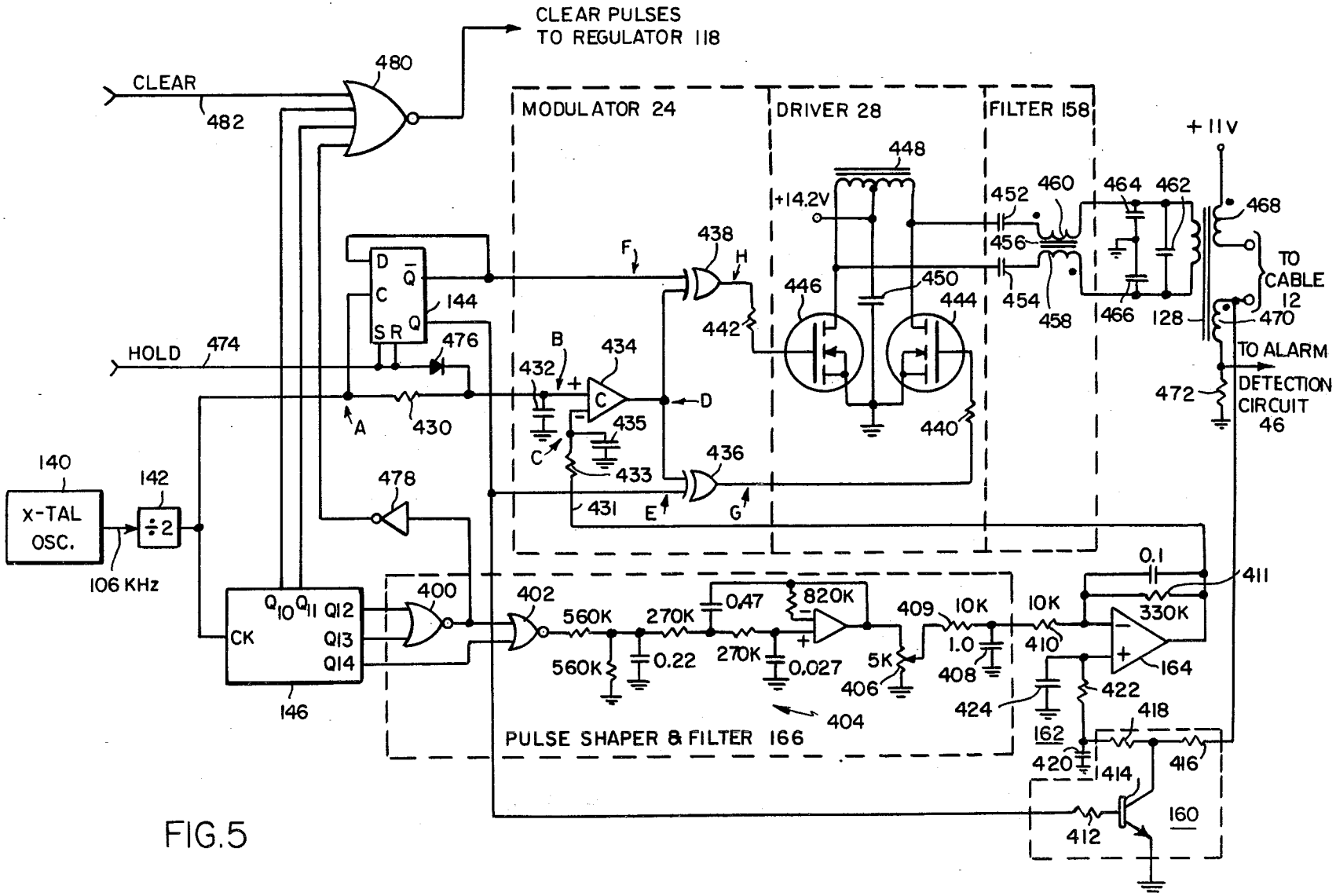
FIG. 5 shows the circuitry of the control unit modulator.

Referring to FIG. 5, there is shown a detailed circuit diagram of the circuitry which generates the ultrasonic signals applied to cable 12. A crystal oscillator 140 provides a 106 kHz squarewave which is applied via flip-flop 142 to a 14 stage counter 146. The output of the last stage of a counter 146 is a squarewave having a frequency of about 3.23 Hz. This is the basic modulation frequency which is used to modulate the ultrasonic carrier frequency.

The outputs from the three last stages. Q12 through Q14 of counter 146 are applied to pulse shaper and filter circuit 166; and these outputs are combined by NOR-gates 400 and 402 to provide a 3.23 Hz pulse train having a 37.5% duty cycle at the output of gate 402. The digital output signal from gate 402 is applied to filter circuitry of a known type and shown generally at 404 to provide a band-limited output signal from which the higher harmonics have been eliminated. The level of the output signal from shaper and filter circuit 166 is adjustable and is determined by the setting of potentiometer 406. Due to multiple reflections and propagation delays, it is desirable to have a minimum modulation interval which is longer than the peak modulation interval. The figure of 37½% is not critical and was chosen because the logic for such a duty cycle is easily realized. A further explanation of this type of circuit is given in U.S. Pat. No. 4,035,798.

The output signal from pulse shaper and filter circuit 166 appears across capacitor 408 and is the desired modulation envelope. This signal is applied via a resistor 410 to the inverting input of a differential amplifier 164. The output modulation envelope is recovered by the circuitry described below and applied to the non-inverting input of amplifier 164. Amplifier 164 compares the two signals applied to its inputs, and a signal representative of the difference between these two waveforms is applied to modulator 24 to produce the desired modulation. This process produces an output modulation envelope which is very precisely controlled to match the desired modulation envelope appearing at the output of pulse shaper and filter circuit 166.

The output modulation envelope is recovered by synchronous detector 160. A 26.5 kHz squarewave from the Q output of flip-flop 144 is applied via a current-limiting resistor 412 to the base terminal of a transistor 414. A sample of the output signal from output transformer 128 is applied via resistor 416 to the collector terminal of transistor 414. The polarities are such that transistor 414 is off during the positive half-cycles of the output waveform from transformer 128, while during the negative half-cycles, transistor 414 saturates clamping the signal fed back through resistor 416 to ground. The result is a series of positive half-cycles appearing at the collector of transistor 414, and the average voltage level of these half-cycles represents the instantaneous level of modulation of the ultrasonic signal on cable 12. Resistors 418 and 422 and capacitors 420 and 424 filter the waveform present at the collector of transistor 414; and a DC signal having a value proportional to the instantaneous amplitude of the ultrasonic output signal from transformer 128 is applied to the non-inverting input of amplifier 164.

Figure 6A:
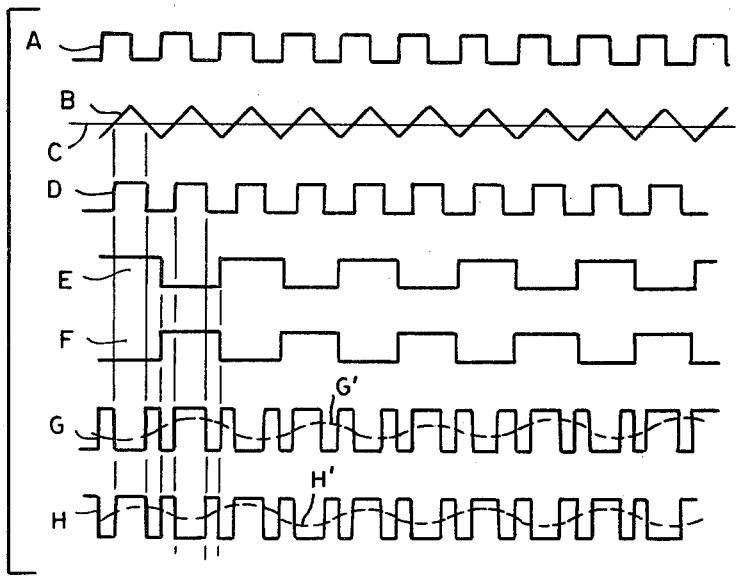
FIGS. 6A–D, 7, 8, and 9 show waveforms useful in explaining the operation of the modulator circuitry shown in FIG. 5.

The operation of modulator 24 is best described by referring to the waveforms shown in FIGS. 6A through 6D. The output from flip-flop 142 is a 53 kHz squarewave, and this signal is applied via a resistor 430 to a capacitor 432. The RC time constant of resistor 430 and capacitor 432 is much longer than one period of the 53 kHz signal from flip-flop 142, and the waveform present at the junction of resistor 430 and capacitor 432 is a 53 kHz triangular wave having a small amplitude. Referring to FIG. 6A, waveform A denotes the 53 kHz squarewave from flip-flop 142 and waveform B is the signal present at the non-grounded terminal of capacitor 432. The 53 kHz squarewave from flip-flop 142 is perfectly symmetrical, and the median DC voltage of the triangular waveform B is equal to half the supply voltage.

Waveform B is applied to the non-inverting input of a high-gain comparator or other amplifier 434. The output signal from amplifier 164, representing the desired error signal, is applied via line 431 to the inverting input of amplifier 434. The waveform, or voltage level, applied to the inverting input of amplifier 434 is denoted as C. Resistor 433 and capacitor 435 decouple any switching transients which may be present in the output of amplifier 164 or which may be picked up by line 431.

For purposes of explanation, assume that the voltage at the input C to amplifier 434 is equal to the median DC voltage for the triangular wave B, as shown in FIG. 6A. The resulting output from amplifier 434 is a 53 kHz squarewave which switches from a high state to a low state as waveform B passes through the voltage level C, and is shown by waveform D in FIG. 6A.

Waveform D is applied to one input of each of two exclusive or (XOR) gates 436 and 438. The second input to XOR gates 436 and 438 are respectively the Q and $\overline{Q}$ outputs from flip-flop 144, which are denoted as waveforms E and F. As shown in FIG. 6A, these waveforms are 26.5 kHz squarewaves which are 180° out of phase. Since the E and F waveforms applied to one input of each of the XOR gates 436 and 438 are squarewaves of opposite phases, and since the same waveform D is applied to the second inputs of these XOR gates the output waveforms from the XOR gates are identical but opposite in polarity. These waveforms are denoted by waveforms G and H in FIG. 6A. The G and H waveforms include a 26.5 kHz fundamental component and higher harmonics of 26.5 kHz. The 26.5 kHz components are denoted as G′ and H′ and are shown by the dotted lines in FIG. 6A. The higher harmonics in waveforms G and H are eventually filtered out by the following circuitry and thus the signal applied to cable 12 in response to waveforms G and H is the 26.5 kHz fundamental signal shown by waveforms G′ and H′ in FIG. 6A.

Figure 6B:
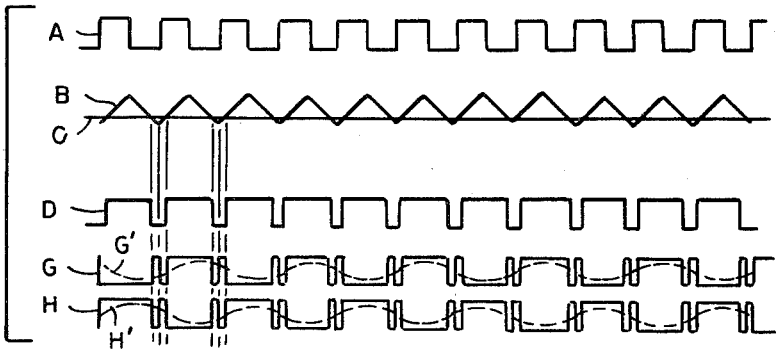
Figure 6C:
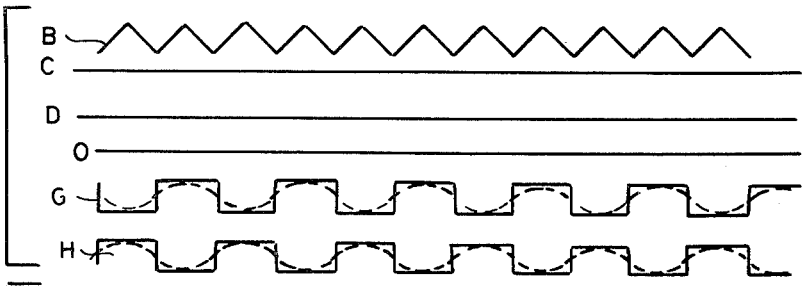

Now assume that the voltage C at the inverting input to amplifier 434 decreases slightly. This is shown in FIG. 6B where the level of the C waveform is now less than the average value of the 53 kHz triangular wave B. The positive output pulses from amplifier 434 widen, as shown by waveform D; and the resulting output waveforms from the XOR gates are shown in waveforms G and H of FIG. 6B. The G and H waveforms of FIG. 6B have a 26.5 kHz fundamental component which is larger than that shown in FIG. 6A; and these fundamental components are again respresented by the dotted lines G′ and H′. Thus, in response to a small decrease in the voltage applied to the C input of amplifier 434, the amplitude of the 26.5 kHz component waveform in waveforms G and H increases. The increase in the power of the 26.5 kHz components in the output signals from XOR gates 436 and 438 increases until the voltage level at point C is just below the lowest voltage of the triangular waveform B. This condition is shown in FIG. 6C. The G and H waveforms from the XOR gates are complimentary 26.5 kHz squarewaves. This is the maximum power condition.

It should be noted that a similar condition occurs when the value of the voltage at point C is higher than the largest value of the triangular waveform B. The result is again 26.5 kHz waveforms at the outputs of the XOR gates; however, in this case the phases of these waveforms are reversed.

Figure 6D:
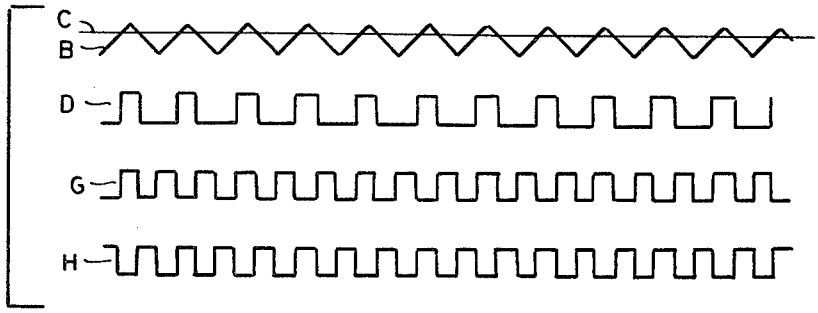

Referring to FIG. 6D, the zero power condition is shown. If the voltage level C is such that the output pulses from amplifier 434 have a duty cycle of one-third, as shown by waveforms B, C, and D in FIG. 6D, the resulting outputs from the XOR gates are squarewaves having a frequency of 3 times the 26.5 kHz fundamental frequency. In this case, the output waveforms from the XOR gates have no 26.5 kHz component.

Figure 7:
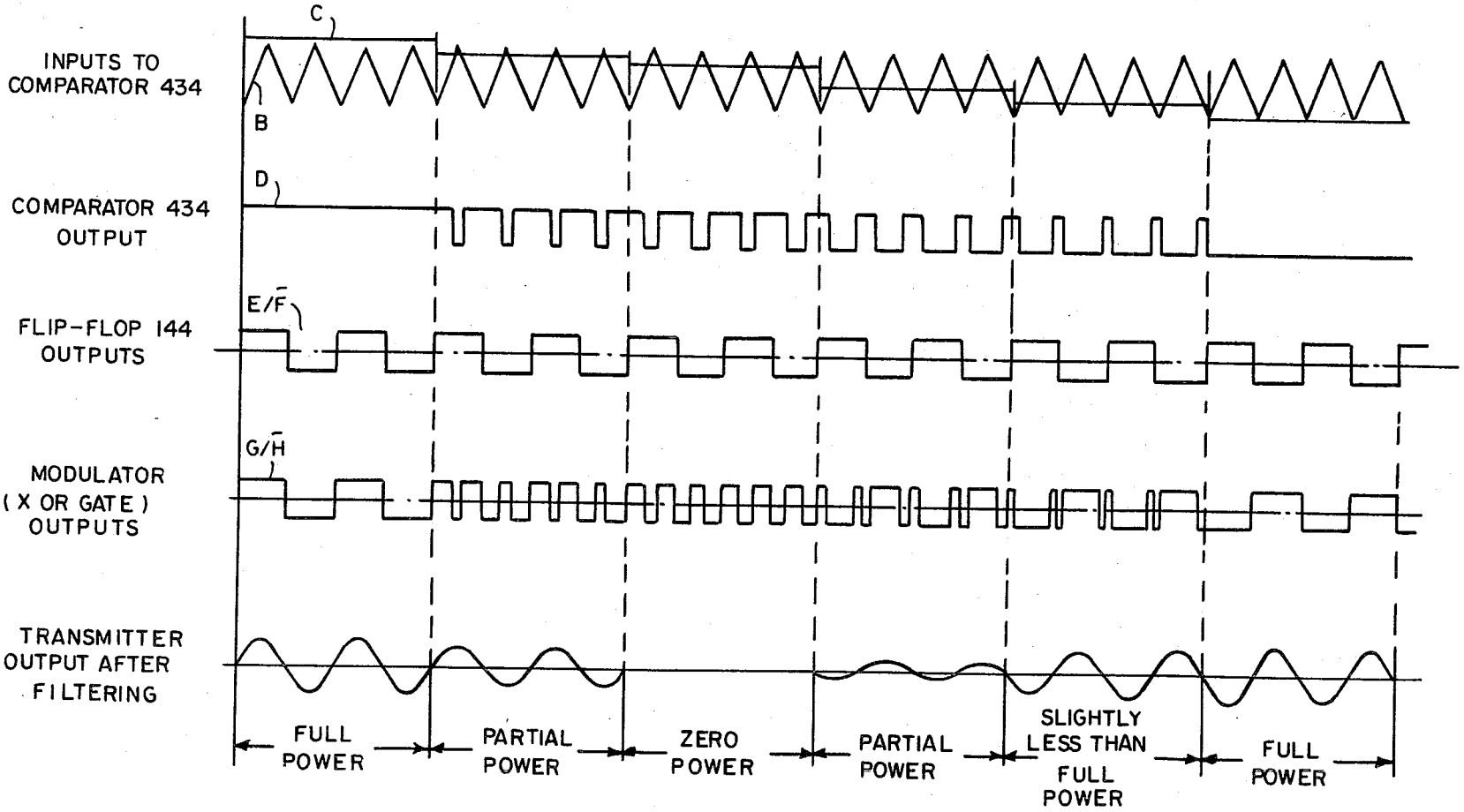

This power change can be better seen by referring to FIG. 7 which shows the waveforms existing at various parts in the circuit of FIG. 5 as the system goes from full power to zero power and back to full power. The top waveform in FIG. 7 is the 53 kHz triangular waveform B. Superimposed on waveform B is voltage C. In the leftmost portion of FIG. 7, signal C is higher than any part of waveform B, corresponding to a full power condition. Proceeding to the right in FIG. 7, the level of signal C drops and the system goes from full power to partial power, and then to zero power when signal C is equal to two-thirds of the peak-to-peak voltage of waveform B. As the level of signal C drops still further from the zero power condition, the output power rises until it again reaches full power when signal C is less than the lowest value of waveform B. The second waveform in FIG. 7 shows the resulting power control waveform D from comparitor 434 applied to the XOR gates 436 and 438. The third waveform in FIG. 7 is a 26.5 kHz squarewave which corresponds to the E and F signals from the Q and $\overline{Q}$ outputs of flip-flop 144. This signal is constant for all power outputs. The next waveform in FIG. 7 shows the resulting G and H outputs of XOR gates 436 and 438, which are the modulator output signals. The bottom waveform in FIG. 7 shows the idealized transmitter output after filtering which results from the G/H waveforms shown. The filtering removes the higher order components from the output of the switching modulator 24 and leaves the 26.5 kHz fundamental.

The bottom waveform in FIG. 7 shows the transmitter output assuming that the transmitter filter 158 and tuned output transformer 128 are completely effective in removing higher order harmonics. It can be seen from FIG. 7 that the partial power waveforms on either side of the zero power output are similar but are inverted in phase with respect to a constant 26.5 kHz signal, such as that shown in the E/F waveform in FIG. 7. Thus, the transmitter can move from the zero power condition to the full power condition in either of two directions, and the transmitted carrier signal will differ by 180°, depending on which direction is chosen.

The existence of two different full-power signals becomes important for the following reason. The transmitter output waveform shown in FIG. 7 is an idealized waveform, as discussed above, which assumes complete elimination of higher order harmonics. In reality, the filters used in the present example do not completely attenuate the higher order harmonics. In particular, the third harmonic remaining in the modulator output is significant, especially when compared with the amplitude of the 26.5 kHz component at or near the minimum power output portion of the 3.23 Hz modulation envelope.

Figure 8:
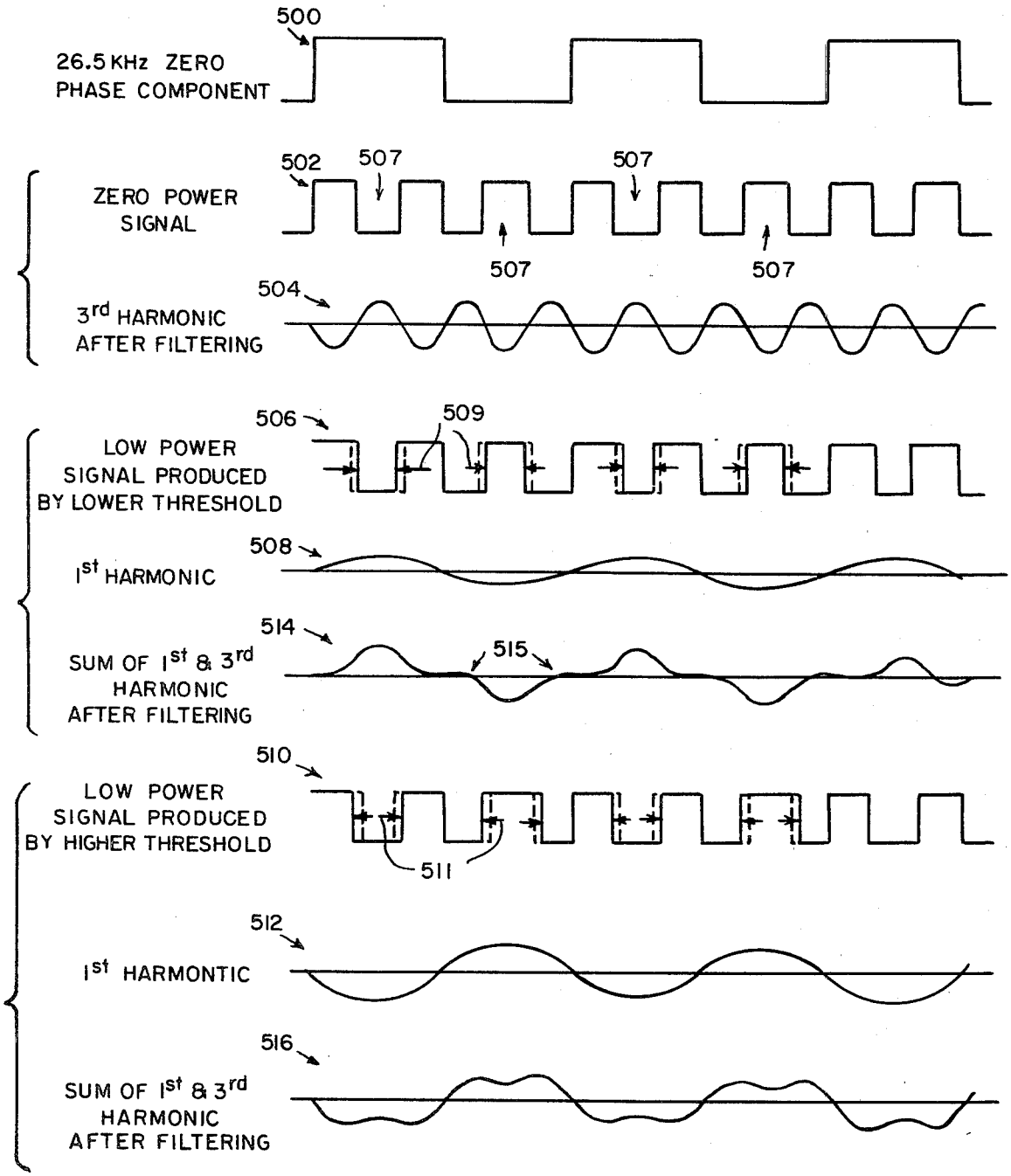

The effect of this surviving third harmonic component may best be described by referring to FIG. 8. Waveform 500 in FIG. 5 is a 26.5 kHz squarewave which represents a zero-phase condition. Waveform 502 represents the outputs from XOR gates 436 and 438 at the zero power point, and is a 79.5 kHz squarewave. Waveform 504 is the attenuated third harmonic from waveform 502 after filtering. Waveform 504 is 180° out of phase with the 79.5 kHz squarewave 502 due to the phase shift due to the modulator filters.

Waveform 502 is composed of a 79.5 kHz component and odd harmonics thereof and contains no 26.5 kHz components. By widening the portions 507 of the waveform 502 which lie in the center of each half cycle of the 26.5 kHz signal 500, a 26.5 kHz fundamental component (or first harmonic) is produced in waveform 502. The phase of the 26.5 kHz component depends whether the waveform is narrowed or widened. This is shown by waveforms 506 through 514. In waveform 506, the portions 507 of waveform 502 has been made slightly narrower as indicated by the arrows at 509. The resulting waveform in 506 has a third harmonic component similar to waveform 504 but slightly reduced in amplitude and also contains a small first harmonic component as shown by waveform 508. The opposite situation is shown in waveform 510, where the portions 507 have been made slightly narrower, as shown by arrows 511. Waveform 510, similar to waveform 506, again contains a third harmonic component which is the same as the waveform 504 but slightly reduced in amplitude. Waveform 510 also contains a fundamental component at 26.5 kHz, shown by waveform 512; however, the fundamental component of waveform 512 is 180° out of phase to waveform 508.

The signal transmitted by control unit 10 over cable 12 in response to waveform 506 includes the sum of the first and third harmonic waveforms 508 and 504, and this signal is shown by waveform 514. As can be seen from FIG. 8 the zero crossings of waveforms 504 and 508 occur in the opposite direction. As a result, the zero crossings of the combined waveform 515 occur much less abruptly and are much more poorly defined. These zero crossings are shown at points 515 on waveform 514. The waveform transmitted over cable 12 in response to a control power waveform such as that shown by waveform 510 similarly includes the sum of waveforms 504 and 512, and the result of combining these two signals is shown by waveform 516. The zero crossings of waveforms 504 and 502 occur in the same direction, and this results in an enhancement of the zero crossings of the signal transmitted along cable 12.

As described above, the signal on cable 12 is applied to a limiter in each of the remote processors 14 to provide a constant 26.5 kHz reference signal for demodulating the received echoes. Waveform 516 is much more suitable for application to a limiter than is waveform 514, since the poorly defined zero crossing 515 in waveform 514, can result in oscillation in response to noise on the cable 12 during the time waveform 514 is very close to zero. In contrast, waveform 516 moves very rapidly through the zero voltage point, and the limiters in the remote processors are much less likely to erroneously switch state in response to noise picked up by cable 12 or elsewhere in the system. For this reason, the wider power control pulses corresponding with waveform 510 are preferred for use in modulator circuit 24. Referring to FIG. 7 these pulses correspond to the waveforms in FIG. 7 lying to the right of the zero power segment.

Since the power control waveforms shown in FIG. 8 are all symmetrical, the power control waveforms 506 and 510 contain only odd harmonic components and do not contain even harmonic components. Thus, those components higher than third order will have zero crossings which are in the same direction as the third harmonic waveform 504 shown in FIG. 8; and any higher order components remaining after being filtered by modulator filter 158 will enhance the effects described above and shown in FIG. 8. It should be noted that if the third and higher order harmonics were completely eliminated by the modulator filter 158, it would not matter which portion of the power control waveforms were used.

Although the desired modulation waveform from filter circuit 166 to drops to zero during the minimum value of each cycle of the modulation waveform, the output modulation envelope from modulator circuit 24 does not drop to zero for the following reasons. At the minimum value of the modulation waveform, the wiper of potentiometer 406 is at zero volts. However, the output of op-amp 164 normally operates near the average voltage of the triangle wave C at the input to comparator 434, which is approximately half the supply voltage. A voltage divider formed by resistors 406, 409, 410, and 411 maintains the voltage at the inverting input of amplifier 164 at a small positive voltage above ground. It is this voltage with which the modulation envelope from transformer 128 and demodulator 166 is compared, and thus, the 26.5 kHz output level is never driven to zero by the modulation circuit shown in FIG. 5. This is essential to ensure that a 26.5 kHz signal is always provided to the remote processors to detect the received echoes.

Returning to FIG. 5, the outputs from each of the XOR gates 436 and 438 are applied via two resistors 440 and 442 to the gate terminals of 2 VMOS power transistors 444 and 446. The sources of these transistors are connected to ground, and the drains of these transistors are connected to opposite ends of a center-tap transformer 148. The center-tap of transformer 448 is connected to the 14.2 volt supply, and a capacitor 450 is connected between the center-tap transformer 448 and ground to reduce the amplitude of any switching transients which may be present at the center-tap of transformer 448.

Transistors 444 and 446 are driven by the G and H signals from XOR gates 436 and 438. As explained above, the G and H signals are digital signals which are identical but opposite in phase. In response to the signals, transistors 444 and 446 are alternately switched on and off. The waveforms at the drain terminals of transistors 444 and 446 are inverted replicas of the G and H signals from the XOR gates plus some ringing due to the inductance of transformer 448 and stray winding capacitance. The peak-to-peak signal voltage at each drain terminal is twice the supply voltage due to the autotransformer action of transformer 448.

The inverted signals applied to the gate terminals of transistors of 444 and 446 are provided by the XOR gates 436 and 438 which are in turn driven by the complimentary outputs from flip-flop 144 and the output of amplifier 434. If the G and H signals were produced by merely inverting the output from one of the XOR gates, the inverted waveform would be delayed slightly due t the propagation time of the inverter. Transistors 444 and 446 would both be in the conducting state for a short period of time during each cycle, resulting in a large current pulse being drawn from the power supply. This would cause unnecessary heating of the VMOS transistors and transformer 448. This would also waste power, which becomes an important consideration when the intrusion alarm system switches to battery-powered mode during a power outage. By using the driving configuration shown in FIG. 5, the signals driving both VMOS transistors are derived by identical processes subject to the same propagation delays.

The VMOS transistors 444 and 446 have a very low equivalent drain to source resistance, typically on the order of 1 ohm. Due to the reactive load seen by the transistors, the drains of the transistors can go negative with respect to the gate when they are on, depending on the external load. The gates of the VMOS transistors are protected from static discharge by internal zener diodes. When the drain voltage goes more than 0.8 volts negative relative to the source, gate current flows through the protective zener. Resistors 440 and 442 prevent the output stages of XOR gates 436 and 438 from being damaged by this gate current.

The drains of each of transistors 444 and 446 are connected to the primary winding of transformer 128 via two series-connected LC filter circuits made up of capacitors 452 and 454 and an inductor 456 having two oppositely-phased windings 458 and 460. The signals appearing at the drains of transistors 444 and 446 contain many harmonics, and the LC filters attenuate these harmonics.

A capacitor 462 is connected across the primary winding of transformer 128, and two capacitors 464 and 466 are connected between each terminal of the primary winding and ground. The values of these capacitors are chosen to tune the primary winding of transformer 128 to the 26.5 kHz fundamental frequency which is to be sent over cable 12. The tuned primary winding of transformer 128 provides further attenuation of the harmonics produced by the switching modulator.

Transformer 128 has two secondary windings 468 and 470. One end of each of the windings of 468 and 470 are connected to the two conductors of cable 12. The other end of secondary winding 468 is connected to the output of 11 volt regulator 118, and the other end of winding 470 is connected to ground via a resistor 472. Thus, DC power is provided from 11 volt regulator 118 to each of the remote processors 14 via cable 12. A balanced 26.5 kHz signal is also applied to cable 12 by means of the split secondary windings 468 and 470. The resistor 472 between winding 470 and ground has very low value, typically on the order of 1 ohm. The signal present at the junction of winding 470 and resistor 472 is applied to alarm detection circuit 46. When a remote processor 14 detects movement, the resulting illumination of the LED in the processor causes a step increase in the current flowing along cable 12 to the remote processors, which also flows through resistor 472. Typically, this current step provides a five millivolt signal across resistor 472 which is applied to the alarm detection circuitry 46.

As described above, the alarm system can be put in hold mode, during which the ultrasonic drive signal is removed from cable 12 so that each of the remote processors remains in its current alarm or non-alarm state. The hold signal from control circuitry 50 disables modulator circuit 24 in the following manner. A normally low hold signal is applied on a line 474 to both the set and reset inputs of flip-flop 144. When the hold signal goes high, both the Q and $\overline{Q}$ outputs from flip-flop 144 are forced high and are prevented from changing state as long as the hold signal is high. The hol signal is also applied via a diode 476 to the non-inverting input of comparator 434. When the hold signal is low, diode 476 is reverse biased and does not conduct. When the hold signal goes high, current flows through diode 476 holding the inverting input of comparator 434 at a high voltage and forcing the output of comparator 434 into a high state. Thus, during hold mode both inputs to XOR gates 436 and 438 are high and the outputs from these gates are both low. This turns off both transistors 444 and 446, and no modulation is transmitted out over cable 12.

Figure 9:
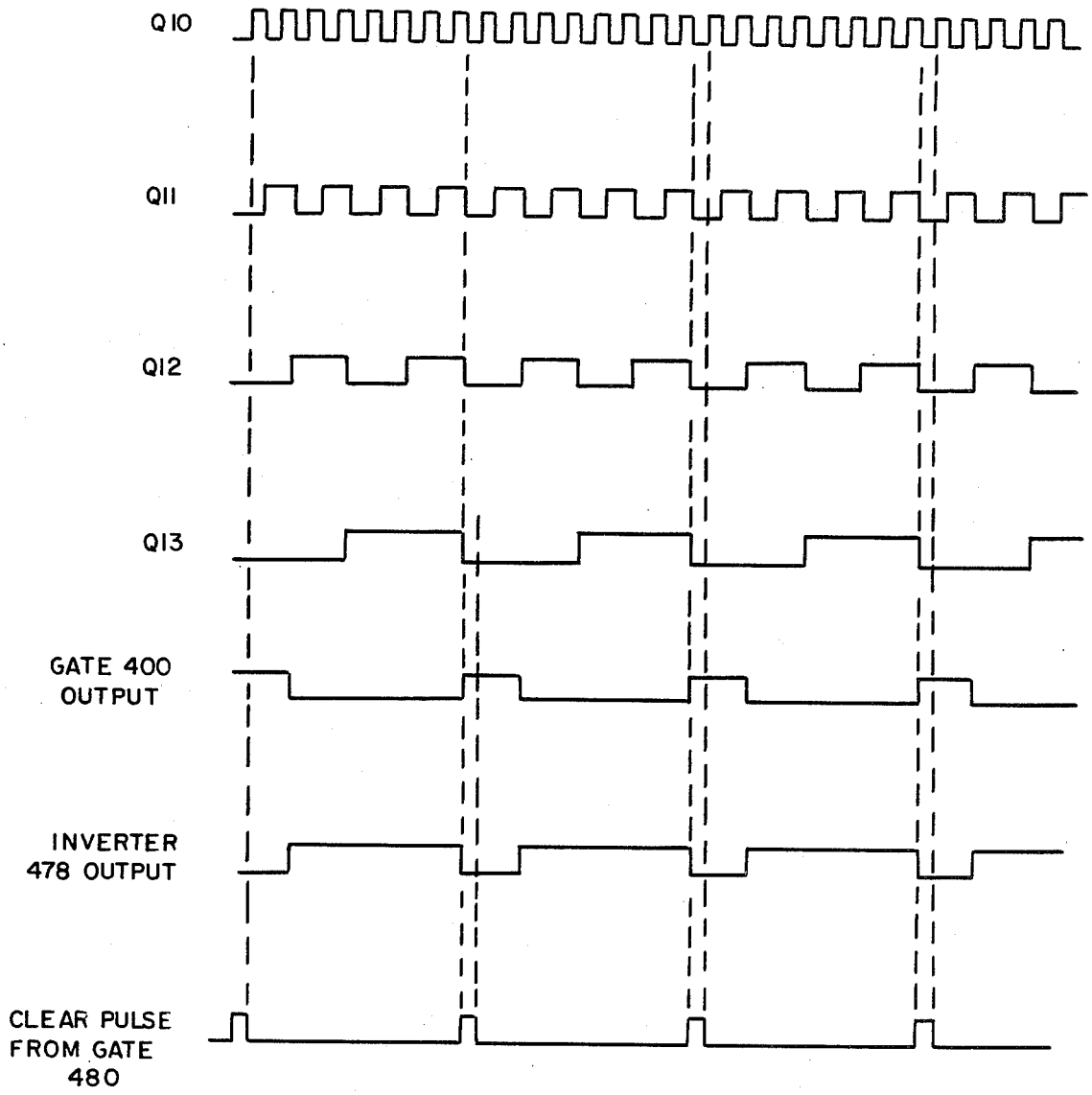

The clear pulses used to periodically disable voltage regulator 118 are derived from counter 146 of the modulator circuitry. Referring to FIG. 5, the $Q_{12}$ and $Q_{13}$ outputs are combined by NOR gate 400 to provide the gate 400 output signal shown in FIG. 9. This signal is inverted by an inverter 478 and applied to a NOR gate 480. The $Q_{10}$ and $Q_{11}$ outputs from counter 146 are also applied to NOR gate 480 and these are combined with the output from inverter 478 as shown in FIG. 9. Thus, when the clear signal on line 482 is low, the output from gate 480 is a series of 9.66 millisecond pulses which repeat at a rate of 6.46 pulses per second or twice the modulation frequency, as shown in FIG. 9.

Figure 10:
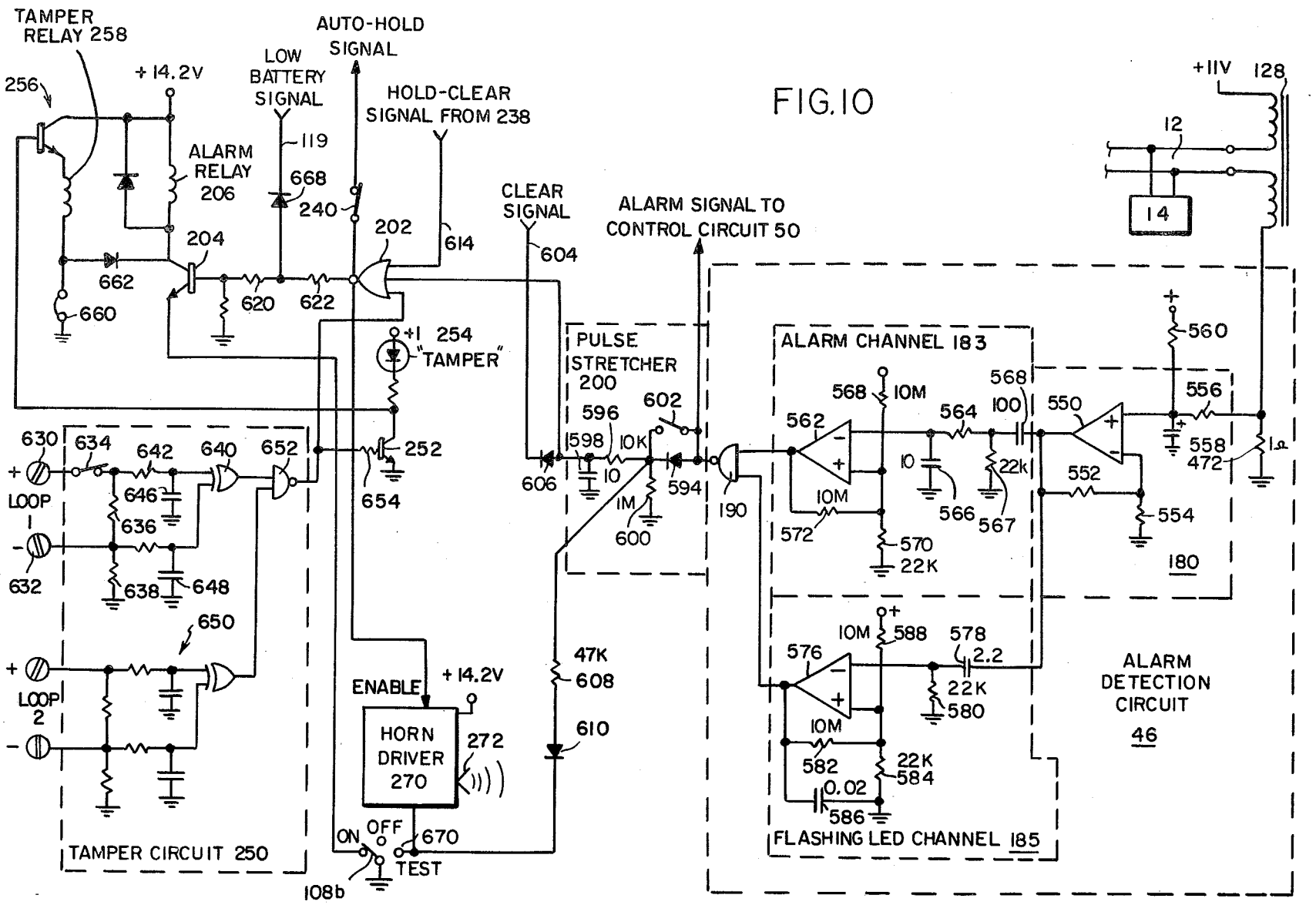
FIG. 10 shows the alarm detection circuitry of the control unit.

Referring to FIG. 10, a detailed circuit diagram of alarm detection circuitry 46 is shown. As explained above, the current drawn by the remote processors 14 flows through resistor 472, and a detection of motion by one or more of the remote processors 14 causes an increase in the current flowing through resistor 472, which typically has a value of about 1 ohm. The voltage across resistor 472 reflects the combined operating load current from all of the remote processors. When a remote processor triggers and its LED turns on, the load current increases by about 5 mA, resulting in a 5 mV increase in the voltage across resistor 472. This voltage is applied to the input terminal of an amplifier 180. Amplifier 180 includes an op-amp 550 connected as a non-inverting amplifier, with a resistor 552 between the output of amplifier 550 and its inverting input, and a resistor 554 between the inverting input and ground. The signal from resistor 472 is applied to the non-inverting input of op-amp 550 via a resistor 556, and a capacitor 558 is connected between the non-inverting input and ground. Resistor 556 and capacitor 558 serve to filter out and attenuate the 26.5 kHz signal present on cable 12 and any noise which may be picked up by cable 12. The time constant of resistor 556 and capacitor 558 is short enough so that the pulses from a flashing LED in a remote processor are transmitted. The non-inverting input to amplifier 550 is biased above ground by a resistor 560 to maintain op-amp 550 in the linear region. The gain of amplifier 180 is determined by ratios of resistors 552 and 554 and should be low enough so that the output of op-amp 550 does not rise above the linear region and saturate when maximum load current flows through resistor 472. A typical value for the gain of amplifier 180 is about 20.

The output from amplifier 180 is applied to an alarm channel filter and trigger circuit 183 and also to a flashing LED channel filter and trigger circuit 185. The output signal from amplifier 180 is applied to the alarm channel circuitry via large value capacitor 568 which removes the DC component from the output from amplifier 180. The signal from capacitor 568 is applied to the inverting input of an op-amp 562 via a resistor 564, and a capacitor 566 is connected between the inverting input and ground. Resistor 564 and capacitor 566 limit the rise time of the alarm channel circuitry and are chosen so that the shorter pulses produced by flashing LED's in the remote processors do not result in an output from the alarm channel circuitry. A resistor 567 connected between capacitor 568 and ground provides a DC return for the inverting input to op-amp 562.

The non-inverting input to op-amp 562 is held slightly above ground by a voltage divider including resistors 568 and 570. A resistor 572 is connected between the output of amp 562 and the non-inverting input, providing positive feedback. The value of resistor 572 is much larger than that of resistor 570, and thus op-amp 562 operates as a Schmitt trigger having an output which is in one of two states and having a small amount of hysteresis in the transfer characteristic. Normally, the output of op-amp 562 is high. Resistors 570 and 572 hold the non-inverting input to op-amp 562 at a slightly positive voltage which corresponds with the upper triggering threshold of the Schmitt trigger circuitry. When the signal from amplifier 180 causes the inverting input to amplifier 562 to rise above the non-inverting input, the output from op-amp 562 goes low. The voltage present at the non-inverting input to op-amp 562 drops to about half the original voltage, since the only current now flowing through resistor 570 is that provided by bias resistor 568. This voltage is the lower Schmitt trigger voltage, and when the inverting input of op-amp 562 drops below this voltage, the output from the alarm channel circuitry again goes high.

The output from amplifier 180 is also applied to circuitry 185 which detects the shorter duration pulses from flashing LED's in remote processors 14. The output from amplifier 180 is applied to the inverting input of an op-amp 576 via a differentiation network made up of a series-connected capacitor 578 and resistor to ground 580. Positive feedback from the output to the input of op-amp 576 is provided by resistors 582 and 584. Typically, a higher speed amplifier is used for op-amp 576 and a capacitor 586 between the output of op-amp 576 and ground may be provided to prevent op-amp 576 from oscillating. The values of capacitor 578 and resistor 580 are chosen so that flashing LED channel 185 responds to each individual pulse from a remote processor whose LED is flashing.

The outputs from alarm channel circuitry 183 and flashing LED channel circuitry 185 are combined by NAND gate 190, and the output from NAND gate 190 is applied to pulse-stretcher circuit 200. In pulse stretcher circuit 200 the output signal from NAND gate 190 is applied to a capacitor 598 by a series-connected diode 594 and resistor 596. The polarity of diode 594 is such that in response to a high output signal from NAND gate 190, capacitor 598 quickly charges up through resistor 596. When the output of NAND gate 190 returns low, diode 594 is reverse biased so that capacitor 598 is not discharged by the low output from NAND gate 190. A large value resistor 600 is connected between resistor 596 and ground to provide a long time constant discharge path for capacitor 598.

A switch or jumper wire 602 is connected across diode 594. When switch 602 is closed, shunting diode 594, pulse stretcher 200 is deactivated. The clear signal from control circuitry 50 is applied to line 604 and via a diode 606 to capacitor 598. When the intrusion alarm circuitry is being cleared, the clear signal goes low to immediately discharge any voltage which may be on capacitor 598. This ensures that the system immediately goes to a non-alarm condition.

If capacitor 598 were not discharged, a voltage stored on that capacitor might erroneously reactivate the alarm circuitry after a clear signal was removed.

The junction of resistors 596 and 600 is connected to the test terminal of switch 107 via resistor 608 and diode 610. When the test mode is selected, diode 610 is grounded allowing capacitor 598 to discharge through resistor 596 and resistor 608. This provides a short time constant for pulse stretcher 200 during test mode.

The output from pulse stretcher 200 is applied to a NOR gate 202. The output from NOR gate 202 is applied via resistors 620 and 622 to the base of alarm relay driver transistor 204. The coil of alarm relay 206 is connected between the 14.2 V power supply and the collector terminal of transistor 204, and the emitter of transistor 204 is normally connected to ground via switch **108*b* when the system is on. Thus, in response an output signal from pulse stretcher 200, the output of NOR gate 202 goes low, turning off transistor 204 and opening the contacts of alarm relay 206**.

A signal from control circuitry 50 is applied on line 614 to a second input of NOR 202. Line 614 is high when the system is in hold or clear mode. Thus, alarm relay 206 indicates an alarm when the system is in hold or clear modes to prevent an operator from inadvertently leaving the system in hold or clear modes.

The positive conductor of cable 12 is routed through a normally-closed tamper switch in each remote processor 14. Both the positive and negative lines of cable 12 may be returned via tamper lines to terminals 630 and 632 of tamper circuitry 250. The positive terminal 630 is interrupted by the cabinet tamper switch 634 for control unit 10. Switch 634 is connected to positive terminal 632 via a resistor 636, and negative terminal 632 is connected to ground via resistor 638. The positive and negative terminals 630 and 632 are connected to the inputs of an XOR gate 640 via resistors 642 and 644. The two inputs to XOR gate 640 are shunted to ground by capacitors 646 and 648.

Normally, terminal 630 is held high by the positive tamper line and terminal 632 is held low by the negative tamper line. This causes the output of XOR gate 640 to be high. Resistor 636 is much smaller than resistor 638, and if the negative tamper line is cut, terminal 632 rises to almost the supply voltage and the output from XOR gate 640 goes low. If the positive tamper line is cut, terminal 630 is pulled down to ground by resistor 636, and the output of XOR gate 640 again goes low. If both positive and negative tamper lines were cut, both inputs to XOR gate 640 go low producing a low output.

Circuitry for a second tamper loop may be provided as indicated at 650. The outputs from XOR gate 640 and circuitry 650 are applied to NAND gate 652. Normally the outputs from the XOR gates are high, indicating a non-tamper condition. In the event that the continuity of cable 12 or tamper line is interrupted, one or both of the inputs to NAND 652 go low causing the NAND gate output to go high.

The output from NAND gate 652 is applied via a current limiting resistor 654 to the base terminal of transistor 252. The emitter of transistor 252 is connected to ground, and the "TAMPER" LED 254 connected between the collector of transistor 252 and the 14.2 V power supply. Thus, in response to an output from tamper circuitry, 250, tamper LED 254 is illuminated. The collector of transistor 252 is connected to the base of tamper relay driver transistor 256. The collector of transistor 256 is connected to the 14.2 V supply voltage, and the coil of tamper relay 258 is connected to the emitter of transistor 256. The tamper output of NAND gate 652 is applied to an input to NOR gate 202; and in response to an interruption in the alarm system wiring which activates tamper circuitry 250, an alarm signal is sent by alarm relay 206.

Normally, the other end of the tamper relay coil 258 is connected to ground via connection 660, and tamper relay 258 is actuated only in response to an output from tamper circuitry 250. If an independent tamper relay is not required, a second set of alarm relay contacts may be provided by cutting wire 660. In this case, the coil of tamper relay 258 is driven through diode 662 by the alarm relay driving transistor 204. The tamper LED 254 indicates when an alarm is caused by tampering regardless of the state of jumper 660.

The low battery signal on line 119 from 11-volt regulator 118 is applied via a diode 668 to the junction of resistors 620 and 622 in the base lead of alarm relay driver transistor 204. In the event of a low battery condition, this signal clamps the base of transistor 204 to ground to produce an alarm signal.

Switch 108 is located at the control unit 10 and allows an operator to turn the alarm system on or off, or to select test mode to verify proper operation of the remote processors and control unit. When switch 108 is set to on, the emitter of transistor 204 is connected to ground via switch **108*b* to permit the above-described operation of the alarm relay 206. When switch 108 is set to off, power is removed from the control unit electronics. When switch 108 is moved to the test position, the emitter of transistor 204 is no longer connected to ground by switch 108*b***, and thus the alarm relay goes to the alarm position when test mode is selected. This prevents the system from being inadvertently left in test mode.

When test mode is selected, switch **108*b* connects the test terminal 670 of switch 108 to the ground. A horn driver circuit 270 is connected between the 14-volt power supply and terminal 670; and connecting terminal 670 to ground provides power to horn driver circuit 270. The output from NOR gate 202 is applied to an enable input to horn driver 270; and when test mode is selected applying power to the horn driver circuitry, a low alarm output signal from NOR gate 202 causes horn driver circuit 270 to activate walk test horn 272**.

Figure 11:
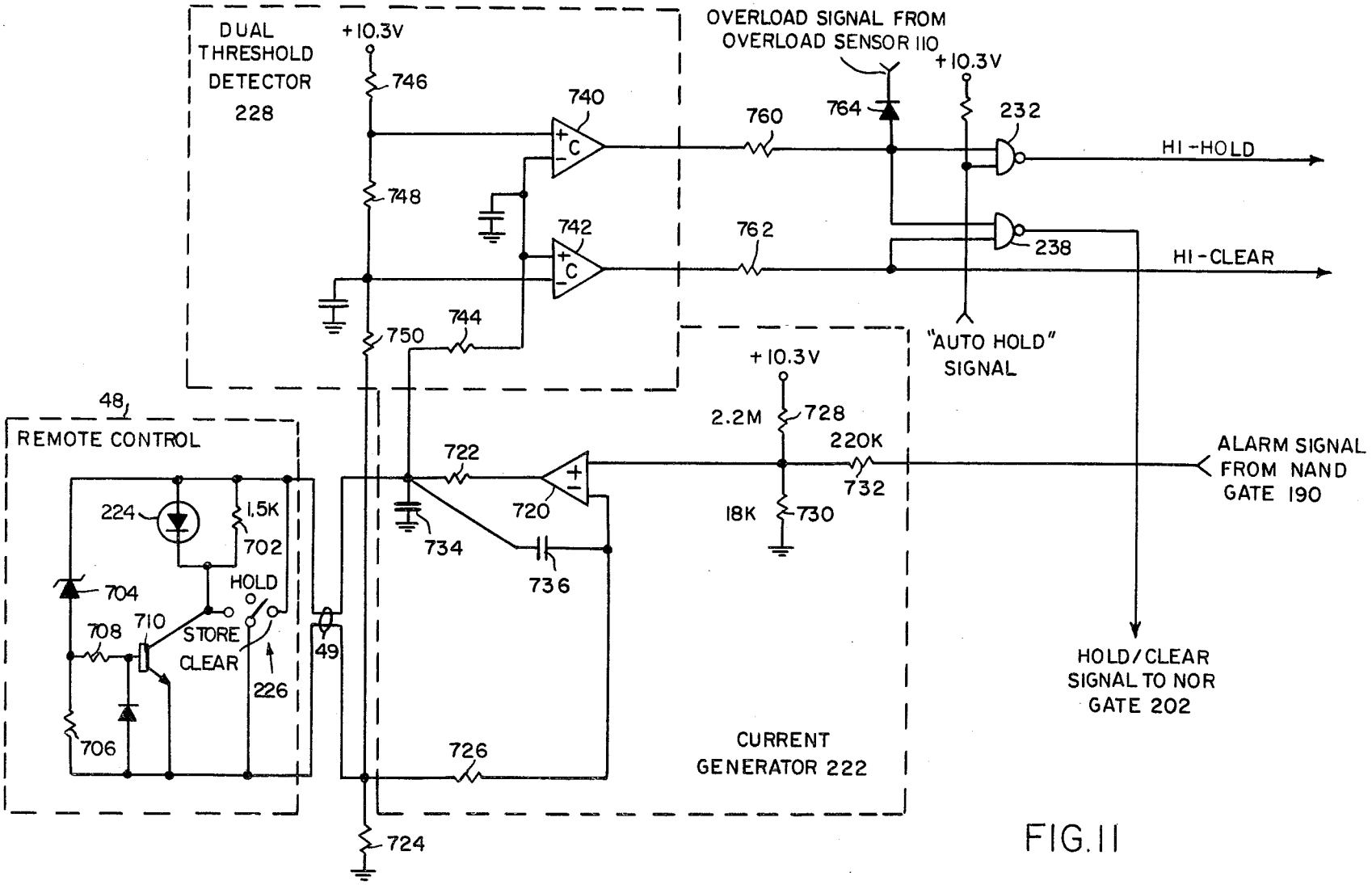
FIG. 11 shows the remote control circuitry of the control unit.

Referring to FIG. 11, detailed circuitry is shown for remote control 48 and control circuitry 50. Remote control unit 48 includes switch 226 which selects the mode of the alarm system, and LED 224 which indicates the state of the system. The switch selects one of three different modes for the alarm system; store mode, hold mode, or clear mode. The LED 224 indicates the state of the system: off indicates that no intrusion has been detected; constantly on indicates that one or more processors is currently detecting motion; and a flashing LED indicates that a processor has previously detected motion.

It is frequently desirable to locate the remote control 48 at a distance from control unit 10. The present invention allows all of the signals for the above-described operation to be transmitted between remote control 48 and control unit 10 over a single two-conductor cable 49.

The remote control unit includes a three-position switch 226 to select the mode of the alarm system. Remote control 48 also includes an LED 224 which indicates the alarm state of the system. LED 224 is connected in parallel with a resistor 702 to the positive conductor of cable 49. Resistor 702 has a value of approximately 1.5 k. The junction of LED 224 and resistor 702 is connected to the store terminal of switch 225. A 5.6-volt zener diode 704 is connected in series with a resistor 706 between the positive and negative terminals of cable 49. The junction of zener diode 704 and resistor 706 is connected by a resistor 708 to the base terminal of a transistor 710. The collector of transistor 710 is connected to the store terminal of switch 226, and the emitter is connected to the negative conductor of cable 49.

Remote control 48 operates in the following manner. The state of the alarm system, as selected by switch 226, is transmitted to control unit as a voltage across the conductors of cable 49. When clear mode is selected, the conductors of cable 49 are shorted by switch 226 and the voltage between the conductors is zero volts. When store mode is selected, the parallel combination of LED 224 and resistor 702 is connected across the conductors of cable 49. The voltage drop across LED 224 when it is illuminated is approximately two volts; and when switch 226 is in the store position, the voltage across the conductors of cable 49 is thus constrained to be approximately two volts or lower. When hold mode is selected, the voltage across cable 49 is determined by zener diode 704 and is approximately six volts. Thus, switch 226 selects the desired mode of operation for the alarm system, and the desired mode is indicated to the control unit by the voltage across the conductors of cable 49.

LED 224 is illuminated in response to an alarm condition in the following manner. A current generator 222 is connected across the conductors of cable 49. Current generator 222 provides one of two levels of current to remote control 48. These levels are 0.8 mA or 8.0 mA. When switch 226 has selected store mode, LED 224 and resistor 702 are connected in parallel directly across cable 49. The lower current level of 0.8 mA flows through resistor 702 and causes a voltage drop of approximately 1.2 volts. This voltage is less than the diode drop across LED 224 and is insufficient to cause the LED to conduct. Thus LED 224 is not illuminated in response to the lower current level. A current of 8 mA causes a voltage drop across resistor 702 which is in excess of the two volt drop across LED 224; and in response to a higher current level applied to cable 49, LED 224 is illuminated.

When hold mode is selected, LED 224 is connected in series with transistor 710 across cable 49. The voltage across cable 49 rises until zener diode 704 starts to conduct turning on transistor 710. At the lower current level of 0.8 mA, part of the current flows through resistor 702 and part of the current flows through zener diode 704 to provide a bias current to the base terminal of transistor 710. The current flowing through resistor 702 is insufficient to illuminate LED 224. In response to the higher current level of 8.0 mA, the current again splits between zener 704 and the parallel combination of LED 224 and resistor 702. Due to the high current gain of transistor 710, most of the 8.0 mA flows through the collector terminal of transistor 710, causing LED 224 to be illuminated.

The current applied to cable 49 is produced by current generator 222. Current generator 222 includes an op-amp 720 whose output is connected to the positive conductor of cable 49 via a low value resistor 722. The negative conductor of cable 49 is returned to ground by resistor 724. Resistor 724 has a low value, typically 100 ohms, and the voltage across resistor 724 provides an indication of the current flowing along cable 49. The voltage across resistor 724 is applied by a resistor 726 to the inverting input of amplifier 720. The negative feedback through resistor 726 causes the current flowing along the conductors of cable 49 to be maintained at a constant value which is determined by the voltage applied to the non-inverting input of amplifier 720. The non-inverting input of amplifier 720 is connected to the 10.3 volt power supply by resistor 728 and to ground by resistor 730. The alarm signal from the output of NAND gate 190 is also applied to the non-inverting input of amplifier 720 via a third resistor 732. When the output from NAND gate 190 is low, indicating a non-alarm condition, the non-inverting input of op-amp 720 is maintained at approximately 80 mV which produces a 0.8 mA current flow through the conductors of cable 49. In response to the detection of an alarm signal, the output of NAND gate 190 goes high raising the voltage applied to the non-inverting input to op-amp 720 to about 0.8 V. This causes the current flowing through cable 49 and applied to remote control 48 to increase to a level of about 8 mA.

A capacitor 734 is connected between the positive conductor of cable 49 and ground; and a second capacitor 736 is connected between the positive conductor and the inverting input to amplifier 720. These two capacitors in conjunction with resistor 722 serve to decouple any noise picked up on cable 49 and to prevent oscillation from occurring in the current feedback loop.

The voltage across the conductors of cable 49 is applied to a dual threshold detector circuit 228. Dual threshold detector circuit 228 includes two comparators or op-amps 740 and 742 which respectively have their inverting and non-inverting inputs connected to the positive conductor of cable 49 through a resistor 744. A voltage divider circuit is made up of resistors 746, 748, and 750 connected between the 10.3 volt power supply and the negative conductor of cable 49. The voltage at the junction of resistors 746 and 748 provides the higher threshold voltage and is applied to the non-inverting input of comparator 740. The voltage at the junction of resistors 748 and 750 provides the lower threshold voltage and is applied to the inverting input of comparator 742. In the presently described embodiment, the upper and lower threshold voltages are approximately 4 and 0.4 volts respectively.

When store mode is selected, the voltage across cable 49 is approximately 1.2 volts and the outputs of comparators 740 and 742 are high. If hold mode is selected, the voltage across cable 49 rises to approximately 6 volts. In response, the output of comparator 740 goes low indicating that hold mode has been selected. The output of comparator 742 remains high. If clear mode is selected, the voltage across cable 49 goes to zero. In response to this, the output of comparator 742 goes low indicating that clear mode has been selected, while the output from comparator 740 remains high.

The hold output from comparator 740 is applied to one input of NAND gates 232 and 238 via resistor 760, and the clear signal from comparator 742 is applied to another input to NAND gate 238 via resistor 762. NAND gates 232 and 238 operate in response to these signals as described above in connection with FIG. 2. The overload signal from overload sensor 110 is connected via a diode 764 to the junction of resistor 760 and the input of NAND gate 232. In response to an overload, the overload signal goes low, pulling the input to NAND gate 232 low also. This causes the transmitter driving signal to be immediately cut off to prevent possible damage to the alarm system circuitry.

Figure 12A:
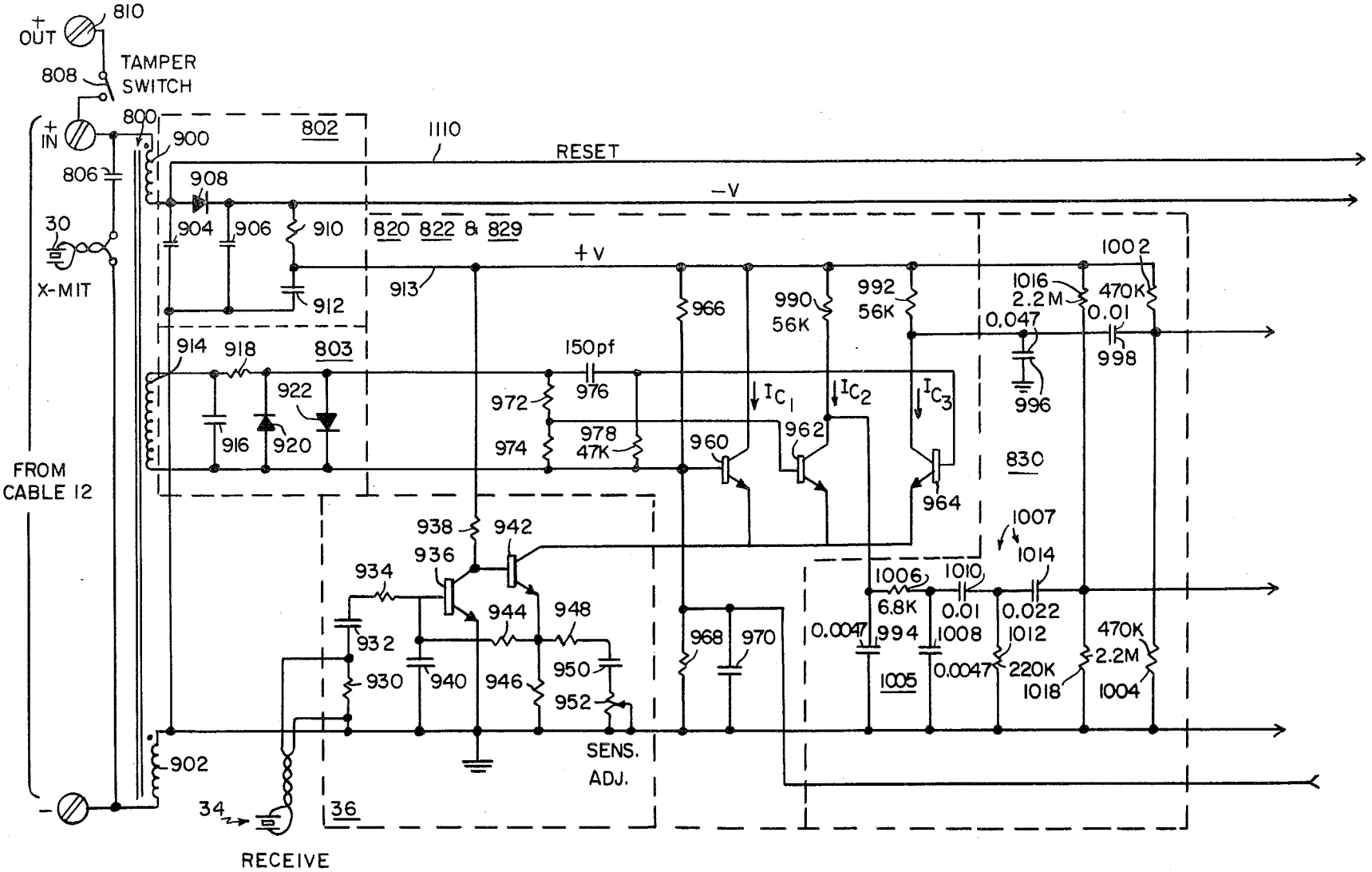
FIGS. 12A and 12B show the detailed circuitry of an exemplary remote processor.
Figure 12B:
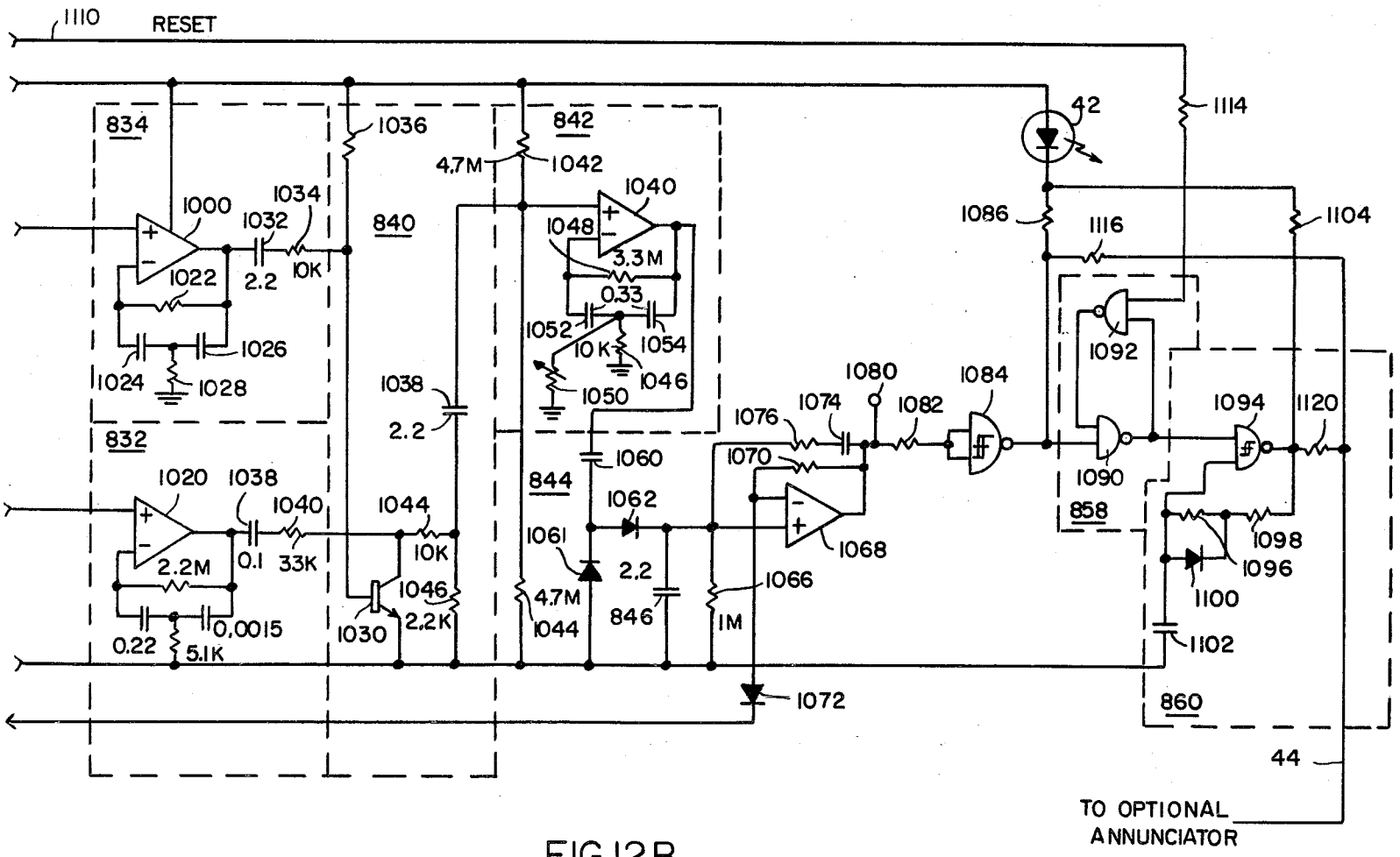

Referring to FIGS. 12A and 12B, a detailed circuit schematic of one embodiment for remote processor 14 is shown. As described above, the signal on cable 12 is applied via AC blocking capacitor 806 to transmitting transducer 30. The signal is also applied to a signal splitting transformer 800. Transformer 800 has two bifilar primary windings 900 and 902. These windings are connected in series by a capacitor 904. The windings are phased to produce additive flux in the core. Common mode noise produces opposing flux components resulting in the reduction or cancellation of common mode noise. In the presently described embodiment, transformer 800 includes bifilar primary windings 900 and 902 having 50 turns each on an AL250 14×8 millimeter core. Secondary winding 914 consists of 200 turns on the core.

The impedance of capacitor 904 to the 26.5 kHz signal is much lower than that of windings of 900 and 902, and a relatively well-filtered DC voltage appears across capacitor 904. It is desirable to have a non-polarized capacitor for capacitor 904 to prevent damage, should the processor be connected to cable 12 with the wrong polarity; and size restrictions limit the value of capacitor 904 which may be practically utilized. Additional filtering is provided by a second capacitor 906 which is connected to the capacitor 904 by a diode 908. Since capacitor 906 is protected by diode 908, capacitor 906 may be a larger value, polarized capacitor which provides more filtering of the DC voltage. Further filtering is provided by resistor 910 and capacitor 912 for DC power applied to the more sensitive portions of the alarm processing circuitry.

The 26.5 kHz appears across secondary winding 914. To reduce the loading on the output stages of the modulator in control unit 10 driving cable 12, the secondary of transformer 800 in each of the remote processors is tuned to a parallel resonance condition at 26.5 kHz by a capacitor 916 connected across the secondary winding. The primary and secondary windings of transformer 800 are tightly coupled, and the high secondary impedence is reflected back to the primary windings. This allows a large number of remote processors to be connected to cable 12 without unduly attenuating the ultrasonic signal on cable 12.

The modulated transmitter signal on cable 12 varies between a maximum of about 30 volts peak-to-peak and a minimum of about 4 volts peak-to-peak. The ratio of turns between secondary 914 and primaries 900 and 902 is 2:1, providing an 8-volt peak-to-peak minimum signal from secondary winding 914. This signal is applied via a resistor 918 to a simple diode limiter circuit 803 including back-to-back diodes 920 and 922. Resistor 918 prevents excessive loading of the transformer secondary winding by the diodes.

In response to echoes from the protected area, receiving transducer 34 applies electrical signals representative of those echoes to amplifier circuit 36. Receiving transducer 34 is loaded by a resistor 930 in the input stage of amplifier 36. The signal from the receiving transducer is applied via a DC blocking capacitor 932 and a resistor 934 to the base of a transistor 936. The transducer output signal is amplified by transistor 936 and the amplified signal appears across a load resistor 938 between the collector of transistor 936 and power supply bus 913. A small capacitor 94 is connected between ground and the base of transistor 936 to filter out any RF interference picked up by the receiving transducer or connecting wiring.

The signal from transistor 936 is applied directly to the base terminal of a second transistor 942. The operating point of the two-stage amplifier is set by a feedback resistor 944 between the emitter of transistor 942 and the base of transistor 936. The gain (transconductance) of transistor 942 is determined by the resistance in the emitter circuit of the transistor. A resistor 946 between the emitter and ground is bypassed by the series-connected combination of resistor 948, capacitor 950, and potentiometer 952. Potentiometer 952 provides a sensitivity adjustment for the remote processor. Capacitor 950 prevents the DC operating point of the amplifier from being changed as potentiometer 952 is adjusted. Resistor 948 sets the minimum resistance in the emitter circuit of transistor 942, and thus the maximum gain.

The collector load for transistor 942 consists of three emitter-coupled transistors 960, 962 and 964. Changing potentiometer 952 changes the AC transconductance of transistor 942 and thus changes the AC gain of the emitter-coupled transistors 960–964. Typically, transistors 936, 942, and 960–964 are matched transistors, such as the transistors contained in a CA3046 transistor array.

The base terminal of transistor 960 is biased at approximately 2.5 volts above ground by resistors 966 and 968, and is bypassed to ground by capacitor 970. The emitter of transistor 960 can drop no lower than one diode drop below the voltage at its base, and transistor 960 thus prevents transistor 942 in amplifier 36 from saturating. The base of transistor 960 also serves as a virtual ground for the 26.5 kHz signal from secondary winding 914.

Figure 13:
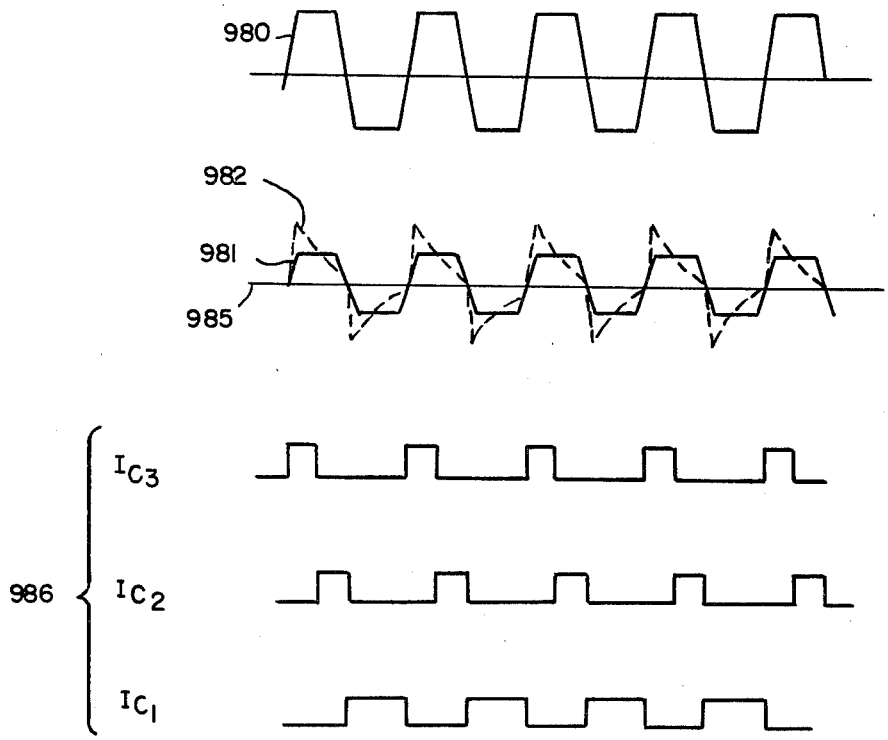
FIGS. 13 and 14 show waveforms useful in explaining the operation of the circuitry shown in FIGS. 12A and 12B.

The manner in which transistors 962 and 964 perform quadrature demodulation of the signal from the receiving transducer 34 can best be described with reference to the waveforms shown in FIG. 13. Waveform 980 in FIG. 13 represents the limited 26.5 kHz reference signal from diodes 920 and 922. A voltage divider composed of equal value resistors 972 and 974 is connected across the output from limiter 804. The signal at the junction of these resistors is applied to the base of transistor 962. This signal is half the amplitude of the limiter output signal and is shown by the solid line waveform 981 of FIG. 13. A differentiation circuit including a capacitor 976 and a resistor 978 is connected across the output from limiter 804, and the output from the differentiation circuit is applied to the base of transistor 964. The differentiated 26.5 kHz waveform applied to transistor 964 is represented by the dotted waveform 982 in FIG. 13. As shown by waveform 982, the differentiated signal 982 reaches a peak approximately twice the amplitude of the signal 981 applied to the base of transistor 962. The level represented by line 985 represents the voltage applied to the base of transistor 960. The collector currents flowing in transistors 960, 962, and 964 are respectively denoted as $I_{C1}$, $I_{C2}$, and $I_{C3}$, as shown in FIG. 12A. The collector current waveforms are shown in FIG. 13 at 986.

In response to a positive half-cycle of the 26.5 kHz limiter output, the differentiated signal 982 applied to the base of transistor 964 rises to a value of approximately twice that of the signal 981 applied to the base of transistor 962. During this period, transistor 964 is on and the other two transistors are off. This is shown by the collector current waveforms 986 in FIG. 13. Following the leading edge of the limiter output signal, the differentiated signal 983 decays away at a rate determined by capacitor 976 and resistor 978; and when the differentiated waveform 983 falls below the squarewave signal 981, transistor 964 turns off and transistor 962 turns on. When the limiter output switches from a positive half-cycle to a negative half-cycle, the signals applied to the bases of transistors 962 and 964 fall below the DC bias signal applied to the base of transistor 960. Accordingly, during the negative half-cycles of the limiter output signal, transistors 962 and 964 are both off. As can be seen from looking at FIG. 13, transistors 962 and 964 each conduct only during one-half of the positive half-cycle of the limited 26.5 kHz signal, and the half-cycle conduction intervals are spaced one-quarter cycle or 90° apart.

The collector current waveforms 986 indicate which of the 3 transistors is on. The collector current of the conducting transistor is determined by amplifier 36, which acts as a current source in the emitter leads of these transistors, and the signal from receiving transducer 34 is demodulated by two, quadrature-related, 26.5 kHz signals. A further explanation of this circuitry can be found in U.S. Pat. No. 3,942,178.

The conduction times of transistor 962 and 964 are nominally equal in width, depending on the tolerances of the voltage divider 972 and 974, the differentiation network, and the transistor offsets. If there is a small difference in these pulse widths, the amplitude balance between the quadrature channels is not exactly equal. This does not significantly affect the performance of the subsequent signal processing circuitry, however, since one signal is amplitude-limited by the subsequent processing circuitry.

The output voltage from each of the demodulators is developed across load resistors 990 and 992 in the collector leads of transistors 962 and 964. These signals contain unwanted higher frequency components resulting from the demodulation process. Two capacitors 994 and 996 connect the collector terminals of these transistors to ground and serve to filter out the unwanted higher frequency signals.

Capacitor 996 also serves as part of the phase difference network 830. The break frequency of capacitor 996 and load resistor 992 is approximately 60 Hz. At frequencies lower than the break frequency, very little phase shift is introduced by these components. The signal from capacitor 996 is applied to a seond capacitor 998, which couples the signal to the input of an op-amp 1000. The DC bias of the input to op-amp 1000 is determined by resistors 1002 and 1004 connected between the power supply and ground.

Capacitor 998 in conjunction with resistors 1002 and 1004 forms a phase lead network. At low Doppler frequencies, the phase lead network is most significant and produces a net phase shift of approximately 90°. As the frequency increases toward the 60 Hz break frequency of resistor 992 and capacitor 996, the phase lead from the phase lead network decreases and the phase lag from capacitor 996 increases. Thus, as the Doppler-shifted frequency increases from a low frequency to a high frequency, the phase shift in the Q' channel gradually changes from a phase lead of 90° to a phase lag of −90°. This is shown in FIG. 14 by curve 1001.

The I' signal from transistor 962 is attenuated by a two-stage RC low-pass network 1005 including load resistor 990 and filter capacitor 994 and resistor 1006 and capacitor 1008. This two-stage low-pass network 1005 provides approximately the same attenuation of the 26.5 kHz component from the demodulator as does capacitor 996; but the network 1004 does not provide any appreciable phase shift in the low frequency portion of the Doppler band. Following low-pass network 1005 is a two-stage phase-lead network 1007 which provides a positive phase shift in the Doppler signal. The first stage of the phase-lead network 1007 includes capacitor 1010 and resistor 1012, and the second stage includes capacitor 1014 and bias resistors 1016 and 1018 which set the DC level of the input to op-amp 1020. The phase-lead network 1007 produces a phase advance of almost 180° at low frequencies. Although the low-pass network 1005 produces a 180° phase lag at very high frequencies, the break frequency of this network is well above the upper limit of the Doppler band; and network 1005 produces only a very small phase shift through the upper frequencies of the Doppler band. The phase shift in the I' signal produced by phase difference network 830 is shown by curve 1003 in FIG. 14.

The outputs from phase difference network 830 are applied to bandpass filters 834 and 832. These two filters are identical and provide a pass band from approximately 50 Hz to 150 Hz. Each filter is composed of a second-order, multiple-feedback active filter. The Q' channel signal is applied to the non-inverting input of op-amp 1000. This is a high impedence point and allows the use of a high impedence phase difference network 830. A resistor 1022 from the output from op-amp 1000 to the inverting input is paralleled by series-connected capacitors 1024 and 1026. The junction of these capacitors is connected to ground via a resistor 1028. The output of the filter appears at the output of op-amp 1000. Filter 832 is identical to filter 834.

The output from filter 834 is applied to the base of a transistor 1030 and the power supply bus provides bias current for the transistor. The output from filter 832 is applied to the collector of transistor 1030 via a DC blocking capacitor 1038 and a resistor 1040.

When there is no Doppler signal, transistor 1030 is held in saturation by the current through resistor 1036. When there is intruder motion, the resulting Doppler signal from filter 834 turns off transistor 1030 on negative half-cycles. Thus, during each positive half-cycle of the Q' signal applied to the base of transistor 1030, transistor 1020 is in saturation, and the I' signal from filter 832 is clamped to ground. During the negative half-cycles of the Q' signal, transistor 1030 is off and the I' signal from filter 832 is no longer constrained. Depending on the relative phasing between the I' and Q' signals, the signal at the collector of transistor 1030 is a series of positive or negative half-cycles of the Doppler signal, depending on whether the moving object is moving away from or towards the receiving transducer.

The signal from transistor 1030 is attenuated by a factor of approximately 5 by a voltage divider composed of resistors 1044 and 1046 connected in series between collector of transistor 1030 and ground. The signal at the junction of these resistors is applied via a DC blocking capacitor 1038 to the non-inverting input of an op-amp 1040. Op-amp 1040 forms part of an active bandpass filter having a center frequency at 3.23 Hz. Bandpass filter 842 is a multiple feedback, second-order active filter, similar to filters 832 and 834 described above. The DC operating point of the bandpass filter is set at half the supply voltage by resistors 1042 and 1044. The center frequency and bandwidth of filter 842 are determined by capacitors 1052 and 1054 and resistors 1046, 1048, and 1050. Typically the bandwidth of filter 842 is 0.1 Hz. It is important that the center frequency be exactly equal to the modulation frequency of 3.23 hertz, and due to its narrow bandwidth, filter 842 generally must be individually tuned to compensate for component tolerances. Tuning may be accomplished by a resistor 1050. Either a variable resistance device may be used for resistor 1050, or tuning may be accomplished by selecting the appropriate resistor and soldering it into the circuit. The latter method has the advantage of allowing the use of a stable, carbon film resistor rather than a potentiometer of lower stability which can also be easily knocked out of adjustment. The remaining components in bandpass filter 842 should also be devices having stable values to insure that the tuning of filter 842 will not drift significantly with time.

The output from bandpass filter 842 is applied via a DC blocking capacitor 1060 to rectifier 844. Rectifier 844 includes two diodes 1061 and 1062 connected in parallel with a capacitor 846. Diodes 1061 and 1062 are polarized such that capacitor 846 is charged only by the positive half-cycles from bandpass filter 842. A resistor 1066 between capacitor 846 and ground provides a discharge path for the capacitor and determines the response time of the alarm circuitry in conjunction with the bandwidth of bandpass filter 842. The signal from capacitor 846 is applied to the non-inverting input of an op-amp 1068. The output of op-amp 1068 is connected to the input via a resistor 1070, and the inverting input is connected to the 2.5 volt reference voltage at the base of transistor 960 via a diode 1072.

The negative feedback through resistor 1070 from the output of op-amp 1068 to the inverting input causes the inverting input to tend to follow the voltage applied to the non-inverting input. As long as the voltage on capacitor 846 is less than the 2.5 volt reference voltage, diode 1072 is reversed-biased, and op-amp 1068 acts as a unity gain voltage follower. If the voltage on capacitor exceeds the 2.5 volt reference, diode 1072 begins to conduct and clamps the inverting input of the op-amp at the 2.5 volt level. Any further increase on the voltage on capacitor 846 causes the output voltage from op-amp 1068 to rapidly approach saturation. Series-connected capacitor 1074 and resistor 1076 between the output of op-amp 1068 and its non-inverting input provide positive AC feedback. Thus, once the voltage on capacitor 846 exceeds the reference voltage, the output of op-amp 1068 is rapidly forced to the supply voltage via this positive feedback. The output of op-amp 1068 remains high as long as the voltage on capacitor 846 exceeds the threshold voltage.

A minimum period for which the output from op-amp 1068 remains high is determined by the RC time constant of capacitor 1074 and resistor 1076. Typically, this period is approximately 2 seconds. Thus, even in response to a very short alarm signal, the output of op-amp 1068 goes high and remains high for a minimum of two seconds.

During periods when no Doppler signal is detected, the voltage present at the output of op-amp 1068 represents the noise level in the system. The sources of this noise include noise in the intruder detection circuitry itself, any ultrasonic frequencies in the Doppler frequency range which would be produced by equipment in the protected area, and a low voltage output from filter 842 which may result from rapid back and forth movement such as fluttering curtains. A test point 1080 may be provided at the output of op-amp 1068 to monitor this voltage.

The output from op-amp 1068 is applied via resistor 1082 to a Schmitt trigger circuit 1084. Schmitt trigger circuit 1084 may be implemented, for example, by a 4093 type quad CMOS NAND Schmitt trigger. The output of Schmitt trigger circuit 1084 is applied via current-limiting resistor 1086 to one terminal of the remote processor LED 42. The other terminal of LED 42 is connected to the power supply line from filter 802. When the output from op-amp 1068 goes high, the output of Schmitt trigger 1084 goes low, illuminating LED 42. LED 42 draws approximately 5 mA and the 5 mA increase in current drawn by the remote processor is detected by the control unit 10 which produces an alarm signal in response.

Two NAND gates 1090 and 1092 are connected to form an R-S flip-flop latch 858. The output from Schmitt trigger 1084 is applied to one input to gate 1090, and in response to a low-output from Schmitt trigger 1084, latch 858 changes state and the output of NAND gate 1090 goes high. The output of NAND gate 1090 is applied to flasher circuit 860. Flasher circuit 860 includes a Schmitt-trigger NAND gate 1094 which has its output connected back to one input via series-connected resistors 1096 and 1098. Resistor 1096 is bypassed by a diode 1100, and a capacitor 1102 connects the input of NAND gate 1094 to ground. The output of NAND gate 1094 is connected to LED 42 via a current-limiting resistor 1104.

When latch 858 is in a non-alarm state, the output from gate 1090 applied to gate 1094 is low forcing the output of gate 1094 to remain high. Capacitor 1102 is charged to the supply voltage through resistors 1096 and 1098 causing the second input to NAND gate 1094 to be in the high state. When latch circuit 858 changes state, the input to NAND gate 1094 goes high forcing the output of gate 1094 low. Resistor 1098 is much smaller than resistor 1096, and capacitor 1102 is quickly discharged through diode 1100 and low value resistor 1098. When the voltage on capacitor 1102 reaches the lower threshold of the Schmitt trigger input to gate 1094, gate 1094 is disabled and its output again goes high. Capacitor 1102 charges up through resistors 1098 and 1096 and the process repeats. During the time that the output from gate 1094 is low, LED 42 is illuminated by the current flowing through resistor 1104. The duty-cycle and repetition rate of the pulses from flasher circuit 860 are determined by the values of capacitor 1102 and resistors 1096 and 1098. In the presently described embodiment, the pulses from gate 1094 illuminating LED 42 are approximately 10 milliseconds long and occur at a rate of approximately 1 pulse per second.

To reset the latches in each of the remote processors, control unit 10 causes the DC voltage on cable 12 to be periodically dropped to zero. The capacitors in power supply 802 of each remote processor store sufficient energy that power to the remote processor electronics is not interrupted during the clear pulses. A signal directly from the junction of primary winding 900 and capacitor 904 is applied via line 1110 and resistor 1114 to the second input of NAND gate 1092 in latch 858. When the power supply voltage on cable 12 drops to zero, the voltage on line 1110 also drops low and resets the R-S flip-flop causing latch 858 to go to the non-alarm state. During this time power is maintained for the remainder of the remote processor electronics via capacitors 906 and 912. Diode 908 prevents these capacitors from being discharged by the clear pulses on cable 12.

If desired, the status of each of the remote processors may be individually displayed on an annunciator panel remotely located from the processors. The output of Schmitt trigger 1084 is applied via a resistor 1116 to a line 44 going to the annunciator. Similarly, a resistor 1120 from the output of NAND gate 1094 in the flasher circuit applies the flasher output signal to line 44 going to the annunicator.

What is claimed is:

1. An intrusion alarm system having a plurality of units capable of being interconnected by a cable having only two conductors for detecting the presence of an intruder in a protected area, the system comprising:

a plurality of ultrasonic transmitting units;

a plurality of ultrasonic receiving units;

a control unit including:

signal means for applying an ultrasonic frequency AC signal to said two conductors of said cable;

means for applying DC power to said two conductors; and means for detecting an alarm signal applied to said two conductors by one of said receiving units and for producing an alarm indication in response to the detection of an alarm signal;

means for connecting said plurality of transmitting units to said cable conductors at various locations in said protected area and responsive to the AC signal on said conductors for transmitting an ultrasonic signal into respective locations in the protected area; and means for connecting said plurality of receiving units to said cable conductors at said various locations, each said receiving unit including:

sensor means for receiving echoes of the transmitted ultrasonic signal in its respective area and for producing an output electric signal representative thereof;

processing means energized by said DC power on said two conductors and responsive to said sensor means output electric signals representative of echoes produced by an intruder for producing an output signal representative thereof; and alarm means including an indicator operable to increase the current drawn from said cable for applying said increased current as said alarm signal to said cable conductors in response to said output signal from said processsing means representative of an intruder presence, said increased current producing said alarm indication at said control unit.

2. An intrusion alarm system having a plurality of units capable of being interconnected by a cable having only two conductors for detecting the presence of an intruder in a protected area, the system comprising:

a plurality of ultrasonic transmitting units;

a plurality of ultrasonic receiving units;

a control unit including:

signal means for applying an ultrasonic frequency AC signal to said two conductors of said cable;

means for applying DC power to said two conductors; and means for detecting an alarm signal applied to said two conductors by one of said receiving units and for producing an alarm indication in response to the detection of an alarm signal;

means for connecting said plurlaity of transmitting units to said cable conductors at various locations in said protected area and responsive to the AC signal on said conductors for transmitting an ultrasonic signal into respective locations in the protected area; and means for connecting said plurality of receiving units to said cable conductors at said various locations, each said receiving unit including:

sensor means for receiving echoes of the transmitted ultrasonic signal in its respective area and for producing an output electric signal representative thereof;

processing means energized by said DC power on said two conductors and responsive to said sensor means output electric signals and said AC signal on said two conductors to detect signals representative of echoes produced by an intruder for producing an output signal representative thereof;

alarm means operable for applying said alarm signal to said cable conductors in response to said output signal from said processing means representative of an intruder presence for producing said alarm indication at said control unit wherein each of the alarm means includes means for increasing the current drawn from the cable conductors by the receiving unit to provide the alarm signal, each of the processing means including means responsive to the AC signal on the two cable conductors for synchronously demodulating the sensor means output signal, wherein the control unit further includes means for amplitude modulating the ultrasonic AC signal applied to the cable conductors at a modulation frequency lower than the ultrasonic frequency; and wherein the processing means includes means for detecting echoes having a frequency component equal to the modulation frequency to distinguish false alarm echoes.

3. The system of claim 2 wherein the modulating means modulates the AC signal by less than 100% to provide a continuous AC signal on the cable for demodulating the sensor means output signal.

4. The system of claim 3 wherein the means for synchronously demodulating includes a limiter response to the AC signal on the cable to produce an amplitude-limited representation of the AC signal for synchronously detecting the received echoes.

5. The system of claims 1, 2 or 3 wherein the receiving units include:

memory means responsive to an alarm signal from the associated processing means for going into an alarm state to provide a continuing indication that an intruder has been detected.

6. The system of claim 5 wherein the receiving units include means, responsive to a clear signal on the two cable conductors, for causing the memory means to go to a non-alarm state; and wherein the control unit includes clearing means, responsive to selection of a clear mode, for sending a clear signal over the two cable conductors.

7. The system of claim 6 wherein the receiving units include means, responsive to the memory means in an alarm condition, for sending a second signal representative thereof over the two cable conductors;

and wherein the control unit includes means for detecting the second signal on the cable conductors and for providing an output indication thereof.

8. The system of claim 7 wherein the control unit further includes means, responsive to selection of a hold mode, for preventing any further detection of objects by the receiving units.

9. The system of claim 8 wherein the means for preventing includes means for interrupting the AC signal applied to the cable by the control unit.

10. The system of claim 6 wherein the clearing means includes means for momentarily interrupting the DC power applied to the conductors of the cable when clear mode is selected.

11. The system of claims 2 or 4 wherein the modulating means includes a switching modulator which applies an AC signal to the cable conductors having a fundamental component and a third harmonic component, the phases of the fundamental and third harmonic components being such that the zero crossings of the AC signal are enhanced.

12. The system of claims 2 or 4 wherein the modulating means includes:

means for producing a first signal of a fundamental frequency equal to the ultrasonic frequency;

power control means for producing a pulse-width-modulated output signal of twice the fundamental frequency and having a duty cycle which is variable in response to a modulation control signal;

means for combining the first signal and the power control means output signal to produce an output signal which includes fundamental frequency components and components which are the third harmonic of the fundamental frequency, the amplitude of the fundamental component varying as a function of a modulation control signal;

output means for applying the combining means output signal to the two cable conductors; and means for providing the modulation control signal to the power control means so as to cause the fundamental commponent and the third harmonic component in the signal applied by the output means to the cable to have a phase relationship which enchances the zero crossings applied to the cable.

13. The system of claim 12 wherein the phase relationship between the fundamental and the third harmonic components in the signal applied to the cable is such that the zero crossings of the third harmonic component which are closest to the zero crossings of the fundamental component are in the same direction as the zero crossings of the fundamental component.

14. For use with an intrusion alarm system of the type having a control unit, a plurality of transmitting units for transmitting a signal into a protected area, and a plurality of receiving units for receiving signals from the protected area and detecting components in the received signals representative of an intruder, the control unit and transmitting units being interconnected by a cable, over which cable the control unit sends an ultransonic AC signal to the transmitting units, a control unit for providing a modulated AC signal at an ultransonic frequency which is modulated at a lower modulation frequency, the control unit comprising:

a first signal source for providing a reference signal at the ultrasonic frequency;

a second signal source for providing a signal at the modulation frequency;

power control means for providing a pulse-width-modulated output signal having a frequency twice that of the ultrasonic frequency and having a duty cycle which is variable in response to a modulation control signal;

means for combining the power control means output signal with the reference signal to provide a digital output signal having a fundamental component at the ultrasonic frequency, the amplitude of which varies as a function of the duty cycle of the power control means output signal; and means responsive to the modulation frequency signal for providing the modulation control signal.

15. An intrusion alarm system having a plurality of units capable of being interconnected by a cable having only two conductors for detecting the presence of an intruder in a protected area, the system comprising:

a plurality of ultrasonic transmitting units;

a plurality of ultrasonic receiving units;

a control unit including:

signal means for applying an ultrasonic frequency AC signal to said two conductors of said cable;

means for applying DC power to said two conductors; and means for detecting an alarm signal applied to said two conductors by one of said receiving units and for producing an alarm indication in response to the detection of an alram signal;

means for connecting said plurality of transmitting units to said cable conductors at various locations in said protected area and responsive to the AC signal on said conductors for transmitting an ultrasonic signal into respective locations in the protected area; and means for connecting said plurality of receiving units to said cable conductors at said various locations, each said receiving unit including:

sensor means for receiving echoes of the transmitted ultrasonic signal in its respective area and for producing an output electric signal representative thereof; and processing means energized by said DC power on said two conductors and responsive to said sensor means output electric signals and said AC signal on said two conductors to detect signals representative of echoes produced by an intruder for producing an output signal representative thereof; and alarm means operable for applying said alarm signal to said cable conductors in response to said output signal from said processing means representative of an intruder presence for producing said alarm indicating at said control unit, wherein the signal means includes a modulator for providing a modulated AC signal of an ultrasonic frequency which is modulated at a lower modulation frequency comprising:

a first signal source for providing a reference signal at the ultrasonic frequency;

a second signal source for providing a signal at a modulation frequency;

power control means for providing a pulse-width-modulated output signal having a frequency twice that of the ultrasonic frequency and having a duty cycle which is variable in response to a modulation control signal;

means for combining the power control means output signal with the reference signal to provide a digital output signal having a fundamental component at the ultrasonic frequency, the amplitude of which varies as a function of the duty cycle of the power control means output signal; and means responsive to the modulation frequency signal for providing the modulation control signal.

16. The system of claim 14 or 15 wherein the modulation control signal is a slowly varying DC signal, the amplitude of which controls the duty cycle of the power control means output signal.

17. The system of claim 16 wherein the power control means includes:

a signal source for providing a triangle-wave signal having a frequency twice that of the ultrasonic frequency;

means for comparing the triangle-wave and the modulation control signal and for providing a periodic output signal representative of which of the two compared signals is larger, the output signal being said power control means output signal.

18. The system of claim 17 wherein the means for combining includes an exclusive OR gate.

19. The system of claim 14 or 15 wherein the modulation control signal providing means includes:

means for demodulating the modulated AC signal to recover the modulation envelope thereof;

means for comparing the modulation envelope with the modulation frequency signal to provide an output signal representative of the difference therebetween; and means for applying the second comparing means output signal to the power control means.

20. The system of claim 19 wherein the AC signal demodulating means includes a synchronous demodulator having two inputs and one output, the modulated AC signal being applied to one input, a signal at the ultrasonic frequency being applied to the other input, and the modulation control signal being derived from the modulator output.

21. The system of claim 20 wherein the digital output signal includes fundamental frequency components and components which are at the third harmonic of the fundamental frequency;

wherein the means for providing the modulation control signal provides a modulation control signal which produces a modulated AC signal which has fundamental and third harmonic frequency components having a phase relationship which enhances the zero crossings of the modulated AC signal.

22. The system of claim 21 wherein the phases of the fundamental and third harmonic components are such that the zero crossings of the third harmonic component which are closest to the zero crossings of the fundamental component are in the same direction as the zero crossings of the fundamental component.

23. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means, including an indicator operable to increase the current drawn from said cable, responsive to the detecting means output signal for operating said indicator and applying said increased current as said alarm signal to the cable for remotely indicating the detection of an intruder.

24. An intrusion alarm system having a plurality of units capable of being interconnected by a cable having only two conductors, for detecting the presence of an intruder in any of a plurality of areas, the system comprising:

a control unit including:

signal means for applying an ultrasonic frequency AC signal to said two cable conductors;

means for applying DC power to said two cable conductors; and means for detecting an alarm signal applied to the two cable conductors by a receiving unit and for producing an alarm indication in response to the detection of an alarm signal;

a plurality of transmitting units connected to the cable conductors and responsive to the AC signal thereon for transmitting an ultrasonic signal into respective areas; and a plurality of receiving units, each connected to the cable conductors and including:

sensor means for receiving echoes of the transmitted signal and for producing an output signal representative thereof;

processing means, responsive to sensor means output signals representative of echoes produced by an intruder, for producing an output signal representative thereof; and alarm means for applying an alarm signal to the cable conductors in response to output signals from the processing means representative of an intruder presence;

wherein each of the alarm means includes means for increasing the current drawn from the cable; and wherein the alarm means includes a light and means responsive to the alarm signal for connecting the light across the cable to illuminate the light and increase the current drawn by the receiving unit from the cable.

25. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means responsive to the detecting means output signal for applying an alarm signal to the cable indicating the detection of an intruder;

wherein the connecting means includes:

a transformer having two primary windings and a secondary winding;

a capacitor connected in series between one terminal of opposite polarity of each primary winding;

the second terminals of each primary winding being respectively connected to the two conductors of the cable;

the DC power for the receiving unit being taken from across the capacitor; and means connected to the transformer secondary winding for providing the reference signal.

26. The receiving unit of claim 25 wherein the signal transmitted by the transmitting units is modulated at a modulation frequency lower than the frequency of the AC signal, and wherein the detecting means includes means for detecting modulation frequency components in the transducer output signal to provide discrimination against signals received by the transducer but not transmitted by a transmitting unit.

27. The receiving unit of claims 23 or 25 further comprising:

a latch circuit having alarm and non-alarm states and providing an output signal representative of the state of the latch;

means for setting the latch to the alarm state in response to a signal from the detection means representative of a detected intruder; and means responsive to the latch output signal for providing an output indication when the latch is in the alarm state.

28. The receiving unit of claim 27 wherein the connecting means includes:

a first capacitor connected across the cable conductors; and a diode in series with a second capacitor, the diode and second capacitor being connected across the first capacitor;

a reset signal for resetting said latch being taken from the first capacitor and DC power for the receiving unit being taken from the second capacitor.

29. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the signal on the cable;

a receiving transducer for receiving signals from the protected area and for providing an electrical output signal representative of the received signals;

means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means responsive to the detecting means output signal for applying an alarm signal to the cable indicating the detection of an intruder;

wherein the connecting means includes:

a transformer having two primary windings and a secondary winding;

a capacitor connected in series between one terminal of opposite polarity of each primary winding;

the second terminals of each primary winding being respectively connected to the two conductors of the cable;

the DC power for the receiving unit being taken from across the capacitor; and means connected to the transformer secondary winding for providing the reference signal; including:

a tuned circuit, of which the secondary winding is a part, having a resonance frequency equal to the frequency of the AC signal on the cable conductors so that the transformer primary windings connected across the cable conductors present a high impedance at the frequency of the AC signal.

30. The receiving unit of claim 29 wherein the reference frequency providing means connected to the secondary winding includes a limiter circuit for providing an amplitude-limited output signal of the frequency of the AC signal.

31. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means, including an indicator operable to increase the current drawn from said cable, responsive to the detecting means output signal for operating said indicator and applying said increased current as said alarm signal to the cable for remotely indicating the detection of an intruder;

wherein the demodulating means includes:

two demodulator circuits, each having first and second inputs and providing an output signal;

means for applying the transducer output signal to the first inputs of each demodulator circuit;

means, responsive to the reference signal, for applying quadrature-related reference signals of the same frequency as the AC signal to the second inputs of the first and second demodulators respectively;

a phase difference network responsive to the output signals from the first and second demodulators for shifting the phase of one of the demodulator output signals by 90° of the reference frequency with respect to the other demodulator output signal to provide two output signals; and means for demodulating one of the phase difference network output signals with the other of the phase difference output signals.

32. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presentce of doppler shifted echoes resulting from intruder movement in the protected area and for producing an output signal representative thereof; and alarm-means responsive to the detecting means output signal for applying an alarm signal to the cable indicating the detection of an intruder;

wherein the demodulating means includes:

two demodulator circuits, each having first and second inputs and providing an output signal;

means for applying the transducer output signal to the first inputs of each demodulator circuit;

means, responsive to the reference signal, for applying quadrature-related reference signals of the same frequency as the AC signal to the second inputs of the first and second demodulators respectively;

a phase difference network responsive to the output signals from the first and second demodulators for shifting the phase of one of the demodulator output signals by 90° of the reference frequency with respect to the other demodulator output signal to provide two output signals; and means for demodulating one of the phase difference network output signals with the other of the phase difference output signals;

wherein the signal transmitted by the transmitting units is modulated at a modulation frequency lower than the frequency of the AC signal, and wherein the detection means further includes:

filter means responsive to signals having a component at the modulation frequency for providing an output signal; and means for applying the demodulating means output signal to the filter means.

33. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means responsive to the detecting means output signal for applying an alarm signal to the cable indicating the detection of an intruder;

a latch circuit having alarm and non-alarm states and providing an output signal representative of the state of the latch;

means for setting the latch to the alarm state in response to a signal from the detection means representative of a detected intruder; and means responsive to the latch output signal for providing an output indication when the latch is in the alarm state;

further including means responsive to a momentary absence of DC power across the conductors of the cable for resetting the latch to the non-alarm state.

34. The receiving unit of claim 33 wherein the connecting means further includes circuitry for continuously providing power to the receiving unit during periods when DC power on the cable conductors is momentarily removed.

35. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means responsive to the detecting means output signal for applying an alarm signal to the cable indicating the detection of an intruder;

wherein the demodulating means includes:

three transistors, the emitters of each of the transistors being connected;

means responsive to the transducer output signal for applying a current to the connected transistor emitters representative of the transducer output signal;

means for applying the reference signal between the base terminal of a first one of the transistors and the base terminal of a second one of the transistors; and means for differentiating the reference signal and for applying the differentiated reference signal between the base terminal of the first transistor and the base terminal of the third transistor;

the signals present at the collector terminals of the second and third transistors being quadrature-demodulated output signals having a 90° phase shift therebetween.

36. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means responsive to the detecting means output signal for applying an alarm signal to the cable indicating the detection of an intruder;

wherein the alarm means includes means for increasing the current drawn by the receiving unit from the cable conductors to provide the alarm signal; and wherein the alarm means includes a light and means responsive to the alarm signal for connecting the light across the cable to illuminate the light and increase the current drawn by the receiving unit from the cable.

37. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means, including an indicator operable to increase the current drawn from said cable, responsive to the detecting means output signal for operating said indicator and applying said increased current as said alarm signal to the cable for remotely indicating the detection of an intruder;

a transformer having two primary windings and a secondary winding;

a capacitor connected in series between one terminal of opposite polarity of each primary winding;

the second terminals of each primary winding being respectively connected to the two conductors of the cable;

the DC power for the receiving unit being taken from across the capacitor; and means connected to the transformer secondary winding for providing the reference signal.

38. For use with an intrusion alarm system of the type having a control unit, a plurality of transmitting units for transmitting a signal into a protected area, and a plurality of receiving units for receiving signals from the protected area and detecting components in the received signals representative of an intruder, the control unit, transmitting units, and receiving units all being interconnected by a cable having two conductors, over which two conductors the control unit sends DC power and an AC signal to the receiving units, and over which two conductors the receiving units send an alarm signal back to the control unit indicating the detection of an intruder, a receiving unit comprising:

connecting means connected to the cable and responsive to the AC and DC signals on the cable for providing DC power to the receiving unit and a reference signal having a frequency equal to that of the AC signal on the cable;

a receiving transducer for receiving signals from the protected area and for providing an electrical output signal representative of the received signals;

demodulating means responsive to the transducer output signal and to the reference signal for demodulating the transducer output signal to provide an output signal;

detecting means responsive to the demodulating means output signal for detecting the presence of doppler shifted echoes resulting from intruder movement in the protected area and for producing an output signal representative thereof; and alarm means, including an indicator operable to increase the current drawn from said cable, responsive to the detecting means output signal for operating said indicator and applying said increased current as said alarm signal to the cable for remotely indicating the detection of an intruder;

wherein the signal transmitted by the transmitting units is modulated at the modulation frequency lower than the frequency of the AC signal, and wherein the detection means further includes:

filter means responsive to signals having a component at the modulation frequency for providing an output signal; and means for applying the demodulating means output signal to the filter means.

* * * * *

UNITED STATES PATENT AND TRADEMARK OFFICE

CERTIFICATE OF CORRECTION

PATENT NO. : 4360905

DATED : November 23, 1982

INVENTOR(S) : Kenneth R. Hackett

It is certified that error appears in the above—identified patent and that said Letters Patent is hereby corrected as shown below:

Col. 3, line 56, change "these" to --These--

Col. 4, line 46, delete "-50" after --49--

Col. 5, line 14, delete the "," after --two--

Col. 6, line 15, change "conuous" to --continuous--

Col. 13, line 56, insert after "118" --which provides power to cable 12. In response, the DC level on cable 12 drops momentarily and then returns high. In the presently described embodiment, the clear pulses are approximately--

Col. 18, line 52, change "148" to --448--

Col. 19, line 9, change "t" at end of line to --to--

Col. 20, line 14, change "hol" to --hold--

Col. 27, line 15, change "94" to --940--

UNITED STATES PATENT AND TRADEMARK OFFICE

CERTIFICATE OF CORRECTION

PATENT NO. : 4,360,905

DATED : November 23, 1982

INVENTOR(S) : Kenneth R. Hackett

It is certified that error appears in the above—identified patent and that said Letters Patent is hereby corrected as shown below:

Col. 28, line 64, change "seond" to --second--

Col. 29, line 19, change "1004" to --1005--

Col. 29, line 62, change "1020" to --1030--

Col. 32, line 27, change "annunicator" to --annunciator--

Claim 2, col. 33, line 18, change "plurlaity" to --plurality--

Claim 12, col. 34, line 58, change "commponent" to --component--

Claim 15, col. 35, line 44, change "alram" to --alarm--

Claim 29, col. 39, delete lines 38-40 and insert--demodulating means responsive to the transducer output signal and to the reference signal for demodulating the transducer output signal to provide an output signal--

Claim 32, col. 41, line 19, change "presentce" to--presence--

Signed and Sealed this

Thirtieth Day of August 1983

[SEAL]

Attest:

GERALD J. MOSSINGHOFF

Attesting Officer

Commissioner of Patents and Trademarks